US009516412B2

(12) United States Patent
Shigenaga et al.

(10) Patent No.: US 9,516,412 B2
(45) Date of Patent: Dec. 6, 2016

(54) DIRECTIVITY CONTROL APPARATUS, DIRECTIVITY CONTROL METHOD, STORAGE MEDIUM AND DIRECTIVITY CONTROL SYSTEM

(71) Applicant: PANASONIC INTELLECTUAL PROPERTY MANAGEMENT CO., LTD., Osaka (JP)

(72) Inventors: Shinichi Shigenaga, Fukuoka (JP); Shuichi Watanabe, Fukuoka (JP); Tadashi Maki, Fukuoka (JP); Akitoshi Izumi, Fukuoka (JP); Kazunori Hayashi, Fukuoka (JP); Toshimichi Tokuda, Fukuoka (JP); Shojiro Matsuo, Fukuoka (JP); Hirotaka Sawa, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 189 days.

(21) Appl. No.: 14/228,738

(22) Filed: Mar. 28, 2014

(65) Prior Publication Data

US 2015/0281833 A1 Oct. 1, 2015

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2430/23* (2013.01)

(58) Field of Classification Search
CPC ..... H04R 1/08; H04R 1/32; H04R 1/326; H04R 1/40; H04R 1/406; H04R 5/04; H04R 3/005; H04R 2201/401; H04R 2430/23; G10L 2021/02166; H04S 7/30; H04S 2400/15; H04S 2420/15; H04N 5/23219; H04N 5/772; H04N 5/23229; H04N 5/23293; H04N 9/8211
USPC ..... 381/92
See application file for complete search history.

(56) References Cited

U.S. PATENT DOCUMENTS 4,559,642 A 12/1985 Miyaji et al.
5,523,783 A 6/1996 Cho et al.
6,157,403 A 12/2000 Nagata (Continued)

FOREIGN PATENT DOCUMENTS

JP 05-260589 10/1993
JP 05-308553 11/1993

(Continued)

OTHER PUBLICATIONS

Search report from E.P.O., mail date is Aug. 28, 2014.

(Continued)

*Primary Examiner* — Vivian Chin
*Assistant Examiner* — Jason R Kurr
(74) *Attorney, Agent, or Firm* — Greenblum & Bernstein, P.L.C.

(57) ABSTRACT

A directivity control apparatus controls a directivity of a sound collected by a sound collecting unit including a plurality of microphones. A beam forming unit forms a beam in a direction from the sound collecting unit toward a sound source corresponding to a position designated in an image on a display unit. A magnification setting unit sets a magnification for magnifying or demagnifying the image in the display according to an input. The beam forming unit also changes a size of the formed beam in accordance with the magnification set by the magnification setting unit.

32 Claims, 21 Drawing Sheets

(56) References Cited

U.S. PATENT DOCUMENTS

| | | | | |
|---|---|---|---|---|
| 8,411,165 | B2 | 4/2013 | Ozawa | |
| 9,210,503 | B2 * | 12/2015 | Avendano | H04R 3/005 |
| 2005/0140810 | A1 | 6/2005 | Ozawa | |
| 2005/0200736 | A1 * | 9/2005 | Ito | G06K 9/00248 348/333.01 |
| 2005/0237395 | A1 | 10/2005 | Takenaka et al. | |
| 2008/0247567 | A1 * | 10/2008 | Kjolerbakken | H04N 7/142 381/92 |
| 2010/0026780 | A1 | 2/2010 | Tico et al. | |
| 2010/0123785 | A1 * | 5/2010 | Chen | H04N 5/23219 348/207.11 |
| 2010/0254543 | A1 | 10/2010 | Kjolerbakken | |
| 2011/0164760 | A1 * | 7/2011 | Horibe | G01S 3/8006 381/92 |
| 2011/0317041 | A1 * | 12/2011 | Zurek | H04R 1/406 348/240.99 |
| 2012/0019689 | A1 | 1/2012 | Zurek et al. | |
| 2013/0029684 | A1 * | 1/2013 | Kawaguchi | H04R 3/005 455/456.1 |
| 2013/0107028 | A1 * | 5/2013 | Glei ner | H04R 3/00 348/77 |
| 2013/0259238 | A1 | 10/2013 | Xiang et al. | |
| 2013/0342731 | A1 * | 12/2013 | Lee | H04N 5/23293 348/231.4 |

FOREIGN PATENT DOCUMENTS

| | | |
|---|---|---|
| JP | 6-133189 | 5/1994 |
| JP | 09-219858 | 8/1997 |
| JP | 10-051889 | 2/1998 |
| JP | 2000-004493 | 1/2000 |
| JP | 2002-223493 | 8/2002 |
| JP | 2005-124090 | 5/2005 |
| JP | 2005-311604 | 11/2005 |
| JP | 2009-130767 | 6/2009 |
| JP | 2009-130854 | 6/2009 |
| JP | 2011-024112 | 2/2011 |
| JP | 2013-157946 | 8/2013 |

OTHER PUBLICATIONS

International Search Report from PCT in PCT/JP2014/001899, mail date is Apr. 28, 2014.

U.S. Appl. No. 14/272,695 to Shinichi Shigenaga et al., filed May 8, 2014.

U.S. Appl. No. 14/228,716 to Michinori Kishimoto et al., filed Mar. 28, 2014.

* cited by examiner 1
2f
2z1
7z
E
f5
f6
f7
f8
u1
u2
2
7y
f9
f10
f11

DIRECTIVITY CONTROL APPARATUS, DIRECTIVITY CONTROL METHOD, STORAGE MEDIUM AND DIRECTIVITY CONTROL SYSTEM

BACKGROUND

1. Field of the Invention

The present invention relates to a directivity control apparatus, a directivity control method and a directivity control system which control directivity of sound data.

2. Description of the Related Art

In a related art, in a monitoring system provided at a predetermined position (for example, on a ceiling surface) of a factory, a shop such as a retail shop and a bank, or a public place such as a library, one or more camera devices such as a PTZ camera device or an omnidirectional camera device are connected to the system via a network to achieve a wide angle of view of image data (including a still image and a moving image, the same applies hereinafter) of a video in a monitoring target range.

Further, since the amount of information obtained by monitoring with a video is limited, a monitoring system in which sound data generated by a specific monitoring target such as a person present within the angle of view of a camera device is obtained using a microphone array device in addition to one or more camera devices is highly demanded. In such a monitoring system, in a case where an observer wants to listen to sound data generated by a specific monitoring target, it is necessary to establish synchronization between image data of a video captured by a camera device and sound data of a sound captured by a microphone array device.

Here, as the related art for establishing synchronization between the image data of video captured by the camera device and the sound data of the sound captured by the microphone array device, a signal processing device disclosed in JP-A-2009-130767 is known.

The signal processing device disclosed in JP-A-2009-130767 calculates a distance to an object captured by an imaging unit according to a result of a zoom operation of the object by a photographer, and emphasizes the sound collected by a microphone unit according to the calculated distance. Further, the signal processing device delays either of a video signal captured by the imaging unit or a sound signal collected by the microphone unit according to the distance to the object from the photographer. By doing this, since the signal processing device delays either the video signal or the sound signal according to the distance to the object even when the zoom operation is performed on the object by the photographer, the synchronization between the video signal and the sound signal can be achieved.

SUMMARY

In JP-A-2009-130767, an emphasis processing of the sound signal collected by the microphone unit is performed in accordance with the zoom operation by the photographer. However, when the configuration of JP-A-2009-130767 is attempted to be applied to the above-described monitoring system and the monitoring range selected by the observer is changed by the zoom operation, there is a possibility that directivity of the sound, from the microphone array device, with respect to a specific object such as a person in a monitoring range changed in accordance with the zoom operation is not properly formed.

When the directivity of the sound data in the monitoring system is not properly formed, a sound generated by the specific object serving as a monitoring target is not transmitted to the observer even if the video and the sound are synchronized, and the efficiency of a monitoring task to be performed by the observer is deteriorated.

A non-limited object of the present invention is to provide a directivity control apparatus, a directivity control method and a directivity control system that form directivity of a sound with respect to an object serving as a changed monitoring target and suppress deterioration of efficiency of a monitoring task to be performed by an observer even when an object serving as a monitoring target is changed in accordance with the zoom processing with respect to the monitoring target.

An aspect of the present invention provides a directivity control apparatus for controlling a directivity of a sound collected by a sound collecting unit including a plurality of microphones, the directivity control apparatus including: a beam forming unit, configured to form a beam in a direction from the sound collecting unit toward a sound source corresponding to a position designated in an image on a display unit; and a magnification setting unit, configured to set a magnification for magnifying or demagnifying the image in the display according to an input, wherein the beam forming unit is configured to change a size of the formed beam in accordance with the magnification set by the magnification setting unit.

An aspect of the present invention provides a directivity control method in a directivity control apparatus for controlling a directivity of a sound collected by a sound collecting unit including a plurality of microphones, the directivity control method including: forming a beam in a direction from the sound collecting unit toward a sound source corresponding to a position designated in an image on a display unit; setting a magnification for magnifying or demagnifying the image in the display according to an input; and changing a size of the formed beam in accordance with the magnification as set.

An aspect of the present invention provides a non-transitory storage medium, in which a program is stored, the program causing a directivity control apparatus for controlling a directivity of a sound collected by a sound collecting unit including a plurality of microphones to execute the following steps of; forming a beam in a direction from the sound collecting unit toward a sound source corresponding to a position designated in an image on a display unit; setting a magnification for magnifying or demagnifying the image in the display according to an input; and changing a size of the formed beam in accordance with the magnification as set.

An aspect of the present invention provides a directivity control system, including; an imaging unit, configured to capture an image in a sound collection area; a first sound collecting unit including a plurality of microphones, configured to collect sound in the sound collection area; and a directivity control apparatus, configured to control a directivity of the sound collected by the first sound collecting unit, wherein the directivity control apparatus includes; a display unit on which image in the sound collection area captured by the imaging unit is displayed; a beam forming unit, configured to form a beam in a direction from the first sound collecting unit toward a sound source corresponding to a position designated in an image on a display unit; and a magnification setting unit, configured to set a magnification for magnifying or demagnifying the image in the display according to an input, wherein the beam forming unit is configured to change a size of the formed beam in accordance with the magnification set by the magnification setting unit.

An aspect of the present invention provides a directivity control system, including: an imaging unit, configured to capture an image in a sound collection area; a first sound collecting unit including a plurality of microphones, configured to collect sound in the sound collection area; a second sound collecting unit disposed in a periphery of the first sound collecting unit; and a directivity control apparatus, configured to control a directivity of the sound collected by the first sound collecting unit and the second collecting unit, wherein the directivity control apparatus includes: a display unit on which image in the sound collection area captured by the imaging unit is displayed; and a beam forming unit, configured to form a beam in a direction from the first sound collecting unit toward a sound source corresponding to a position designated in an image on a display unit according to a designation of the position.

According to aspects of the present invention, directivity of a sound with respect to an object serving as a changed monitoring target is appropriately formed and deterioration of efficiency of a monitoring task to be performed by an observer can be suppressed even when the object serving as a monitoring target is changed in accordance with a zoom processing with respect to the monitoring target.

DETAILED DESCRIPTION

Hereinafter, respective embodiments of a directivity control apparatus, a directivity control method and a directivity control system will be described with reference to the accompanying drawings. The directivity control system of respective embodiments is used as a monitoring system including a manned monitoring system and an unmanned monitoring system disposed in, for example, a factory, a public facility such as a library or an event hall or a shop such as a retail shop or a bank.

In addition, the present invention can be realized as a program causing a computer serving as the directivity control apparatus to execute an operation prescribed by the directivity control method or a computer readable recording medium in which a program causing a computer to execute an operation prescribed by the directivity control method is recorded.

First Embodiment

Figure 1:
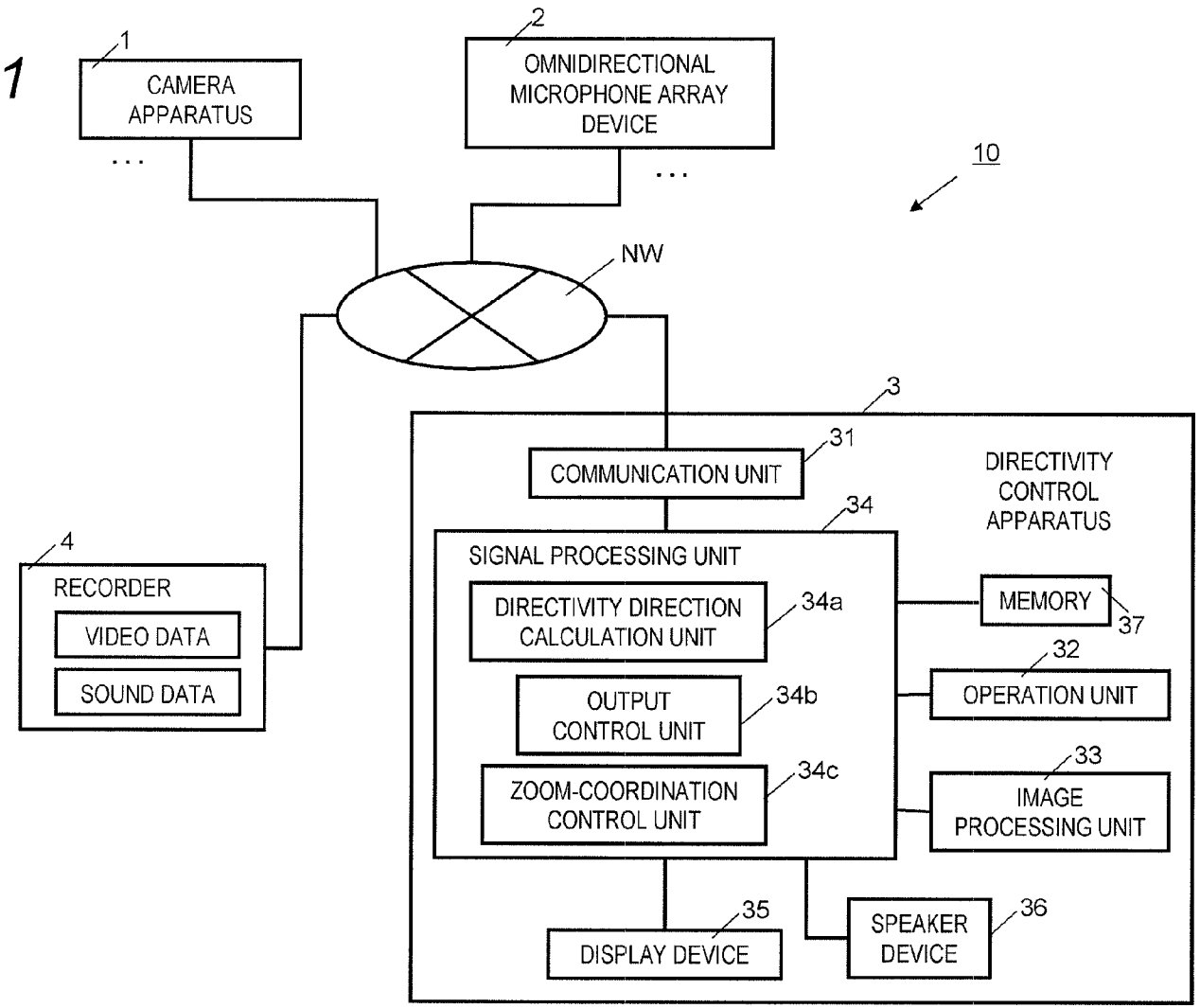
FIG. 1 is a block diagram illustrating a system configuration of a directivity control system according to a first embodiment.

FIG. 1 is a block diagram illustrating a system configuration of a directivity control system 10 according to a first embodiment. The directivity control system 10 in FIG. 1 has a configuration including a camera device 1, an omnidirectional microphone array device 2, a directivity control apparatus 3, and a recorder 4. The camera device 1, the omnidirectional microphone array device 2, the directivity control apparatus 3, and the recorder 4 are connected to each other via a network NW. The network NW may be a wired network (for example, Intranet or Internet) or may be a wireless network (for example, a wireless Local Area Network (LAN), WiMAX (registered trademark), or a wireless Wide Area Network (WAN)). In the directivity control system 10 shown in FIG. 1, only one camera device 1 and one omnidirectional microphone array device 2 are illustrated for convenience of description, but a plurality of camera devices and omnidirectional microphone array devices may be included.

Hereinafter, respective devices constituting the directivity control system 10 will be described. For convenience of description hereinafter, a description will be made of a housing of the camera device 1 and a housing of the omnidirectional microphone array device 2 integrally attached to the same position (see FIG. 5A). Alternatively, the housing of the camera device 1 and the housing of the omnidirectional microphone array device 2 may be separately attached to different positions.

The camera device 1 as an example of an imaging unit is disposed by being fixed to a ceiling surface 8 of an event hall via, for example, a ceiling-mounted metal plate 7*z* described below (see FIG. 5A). For example, the camera device 1 has a function as a monitoring camera in the monitoring system and captures an omnidirectional video of a predetermined sound collection area (for example, a predetermined area in an event hall) using a zoom function (for example, a zoom-in processing or a zoom-out processing) by a remote operation from a monitoring and control room (not illustrated) connected to the network NW. The camera device 1 transmits image data (that is, omnidirectional image data) showing an omnidirectional video of the sound collection area or plane image data generated by performing a predetermined distortion correction processing on omnidirectional image data to be converted into panoramic image data to the directivity control apparatus 3 or the recorder 4 via the network NW.

When an arbitrary position of the camera device 1 is designated by a finger 95 of an observer in image data displayed on a display device 35, the camera device 1 receives coordinate data of a designated position in image data from the directivity control apparatus 3, and calculates data of the distance and a direction (including a horizontal angle and a vertical angle; the same applies hereinafter) from the camera device 1 to a sound position in a real space corresponding to the designated position (hereinafter, simply referred to as a "sound position") and transmits the calculated data to the directivity control apparatus 3. Further, a data calculation processing of the distance and the direction in the camera device 1 is a known technique, so the description thereof will be omitted.

In addition, the camera device 1 performs a zoom-in processing or a zoom-out processing of image data according to, for example, a periodic timing in the camera device 1 or an input operation of the finger 95 of the observer with respect to the image data displayed on the display device 35. The periodic timing is, for example, approximately once every hour or every ten minutes. The information related to the magnification of the zoom-in processing or the zoom-out processing may be designated in advance or be appropriately changed. The camera device 1 transmits the information related to the magnification of the zoom-in processing or the zoom-out processing to the directivity control apparatus 3 after the zoom-in processing or the zoom-out processing is performed.

The omnidirectional microphone array device 2 as an example of a sound collecting unit is fixed to the ceiling surface 8 of an event hall and disposed via, for example, a ceiling-mounted metal plate 7*z* described below (see FIG. 5A). The omnidirectional microphone array device 2 includes at least a microphone with plural microphone units 22 and 23 (see FIGS. 2A to 2E) provided at equal intervals and a CPU 2*p* (see FIG. 21) controlling operations of each of the microphone units 22 and 23 of the microphone.

The omnidirectional microphone array device 2 performs a predetermined sound signal processing (for example, an amplification processing, a filter processing, or an addition processing) on sound data of the sound collected by a microphone element in the microphone unit when the power source is turned on, and transmits the sound data obtained by the predetermined sound signal processing to the directivity control apparatus 3 or the recorder 4 via the network NW.

Here, the appearance of the housing of the omnidirectional microphone array device 2 will be described with reference to FIGS. 2A to 2E. FIGS. 2A to 2E are appearance views of the housing of the omnidirectional microphone array device 2. The omnidirectional microphone array devices 2C, 2A, 2B, 2, and 2D shown in FIGS. 2A to 2E vary in the appearance and the arrangement positions of plural microphone units, but the functions of the omnidirectional microphone array devices are the same.

Figure 2A:
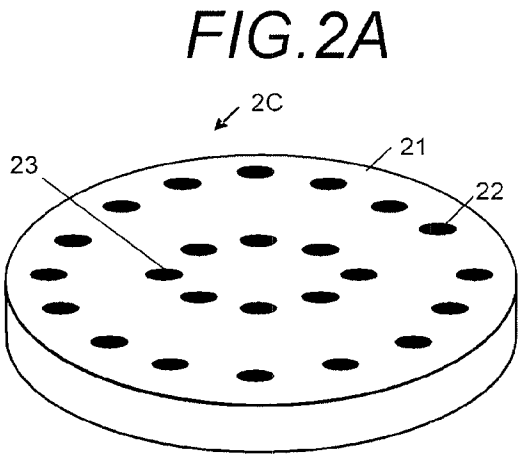
FIGS. 2A to 2E are appearance views illustrating a housing of an omnidirectional microphone array device.

The omnidirectional microphone array device 2C shown in FIG. 2A includes a disc-like housing 21. Plural microphone units 22 and 23 are concentrically arranged in the housing 21. Specifically, plural microphone units 22 are concentrically arranged so as to have the same center as the housing 21 or are arranged along the circumference of the housing 21, and plural microphone units 23 are concentrically arranged to have the same center as the housing 21 or are arranged in the housing 21. Respective microphone units 22 have wide intervals from one another, large diameters, and characteristics suitable for a low pitch range. In contrast, respective microphone units 23 have narrow intervals from one another, small diameters, and characteristics suitable for a high pitch range.

Figure 2B:
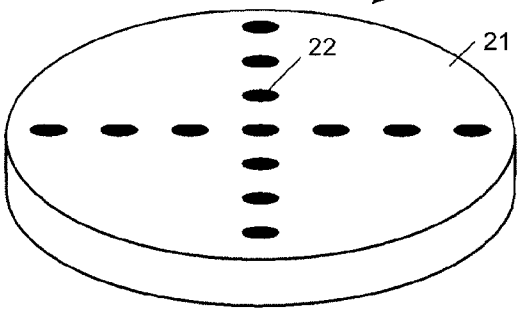

The omnidirectional microphone array device 2A shown in FIG. 2B includes a disc-like housing 21. Plural microphone units 22 are arranged in the housing 21 in a cross shape along two directions of the longitudinal direction and the transverse direction at equal intervals, and the arrangement in the longitudinal direction and the arrangement in the transverse direction intersect with each other in the center of the housing 21. Since the plural microphone units 22 are linearly arranged in two directions of the longitudinal direction and the transverse direction in the omnidirectional microphone array device 2A, the arithmetic amount in a case of forming the directivity of the sound data can be reduced. In addition, in the omnidirectional microphone array device 2A shown in FIG. 2B, the plural microphone units 22 may be arranged in only one line in the longitudinal direction or the transverse direction.

Figure 2C:
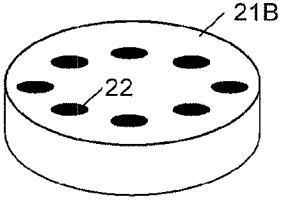

The omnidirectional microphone array device 2B shown in FIG. 2C includes a disc-like housing 21B having a diameter smaller than that of the omnidirectional microphone array device 2 shown in FIG. 2A. The plural microphone units 22 are arranged in the housing 21B with equal intervals along the circumference of the housing 21B. The omnidirectional microphone array device 2B shown in FIG. 2C has a characteristic suitable for a high pitch range since the intervals of respective microphone units are short.

Figure 2D:
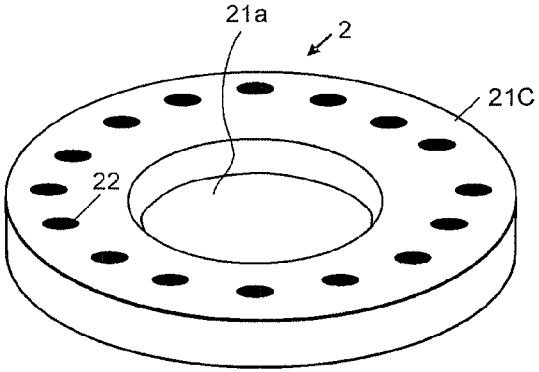

The omnidirectional microphone array device 2 shown in FIG. 2D includes a doughnut-like housing 21C with an opening 21*a* having a predetermined diameter in the center of the housing 21C formed therein or a ring shaped housing 21C. In the directivity control system 10 of the present embodiment, the omnidirectional microphone array device 2 shown in FIG. 2D can be used. The plural microphone units 22 are concentrically arranged in the housing 21C with equal intervals along the circumferential direction of the housing 21C.

Figure 2E:
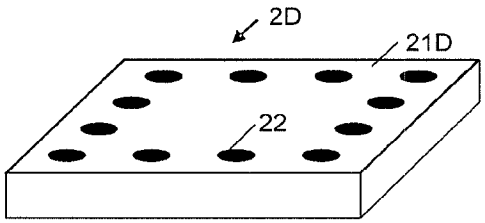

The omnidirectional microphone array device 2D shown in FIG. 2E includes a rectangular housing 21D. The plural microphone units 22 are arranged in the housing 21D with equal intervals along the circumference of the housing 21D. In the omnidirectional microphone array device 2D shown in FIG. 2E, since the housing 21D is rectangular, the arrangement of the omnidirectional microphone array device 2D can be easily performed even in a corner or on a wall surface.

Respective microphone units 22 and 23 of the omnidirectional microphone array device 2 may be a nondirectivity microphone, a bidirectivity microphone, a unidirectivity microphone, a sharp directivity microphone, a superdirectional microphone (for example, a shotgun microphone), or a combination of those microphones.

The directivity control apparatus 3 may be a stationary Personal Computer (PC) arranged in, for example, a monitoring and control room (not illustrated), or a data communication terminal such as a portable telephone which can be carried by an observer, a Personal Digital Assistant (PDA), a tablet terminal, or a smart phone.

The directivity control apparatus 3 includes at least a communication unit 31, an operation unit 32, an image processing unit 33, a signal processing unit 34, a display device 35, a speaker device 36, and a memory 37. The signal processing unit 34 includes at least a directivity direction calculation unit 34*a*, an output control unit 34*b*, and a zoom-coordination control unit 34*c*.

The communication unit 31 receives image data transmitted from the camera device 1, information related to magnification of the zoom-in processing or the zoom-out processing, or a sound data transmitted from the omnidirectional microphone array device 2 and outputs the data to the signal processing unit 34.

The operation unit 32 is a user interface (UI) for informing the signal processing unit 34 of an input operation by an observer, and is a pointing device such as a mouse or a keyboard. Alternatively, the operation unit 32 may be formed with a touch panel arranged corresponding to a display screen of the display device 35 and which can detect the input operation by the finger 95 or a stylus pen of the observer 5.

The operation unit 32 outputs coordinate data of the designated position designated by the finger 95 of the observer among pieces of image data (that is, image data captured by the camera device 1) displayed on the display device 35 to the signal processing unit 34. Further, the operation unit 32 outputs instruction items of the zoom-in processing or the zoom-out processing to the signal processing unit 34 in a case where the zoom-in processing or the zoom-out processing is instructed to be performed by the input operation using the finger 95 in the image data displayed on the display device 35.

The image processing unit 33 performs a predetermined image processing (for example, face detection of a person or motion detection of a person) with respect to the image data displayed on the display device 35 according to the instruction of the signal processing unit 34 and outputs the results of the image processing to the signal processing unit 34.

The image processing unit 33 detects the contour of a face of a changed monitoring target (for example, a person) displayed on a display area of the display device 35 after the zoom-in processing according to the instruction of the signal processing unit 34 in a case where the zoom-in processing is performed by the camera device 1 and performs a masking processing on the face. Specifically, the image processing unit 33 calculates the rectangular area containing the contour of the detected face and performs a predetermined vignetting processing in the rectangular area. The image processing unit 33 outputs the image data generated by the vignetting processing to the signal processing unit 34.

The signal processing unit 34 is formed with, for example, a Central Processing Unit (CPU), a Micro Processing Unit (MPU), or a Digital Signal Processor (DSP), and performs a control processing for controlling the entire operations of respective units of the directivity control apparatus 3, an I/O processing of the data between other units, an arithmetic (calculation) processing of data, and a memory processing of data.

When coordinate data of the designated position of the image data designated by the finger 95 of the observer is acquired at the time of calculation of the directivity direction coordinate ($\theta_{MAh}$, $\theta_{MAv}$) from the operation unit 32, the directivity direction calculation unit 34*a* transmits the coordinate data to the camera device 1 from the communication unit 31. The directivity direction calculation unit 34*a* acquires data in the direction from an installation position of the camera device 1 to a sound position (or a position of a sound source) in a real space corresponding to the designated position of the image data, and data of the direction, from the communication unit 31.

The directivity direction calculation unit 34*a* calculates a directivity direction coordinate ($\theta_{MAh}$, $\theta_{MAv}$) in the directivity direction toward the sound position from the installation position of the omnidirectional microphone array device 2 using the data of the distance from the installation position of the camera device 1 to the sound position, and the data of the direction. As shown in the present embodiment, in a case where the housing of the omnidirectional microphone array device 2 is integrally attached so as to surround the housing of the camera device 1, the direction (the horizontal angle or the vertical angle) from the camera device 1 to the sound position can be used as the directivity direction coordinate ($\theta_{MAh}$, $\theta_{MAv}$) from the omnidirectional microphone array device 2 to the sound position. In addition, in a case where the housing of the camera device 1 and the housing of the omnidirectional microphone array device 2 are separately attached, the directivity direction calculation unit 34*a* calculates the directivity direction coordinate ($\theta_{MAh}$, $\theta_{MAv}$) from the omnidirectional microphone array device 2 to the sound position using data of a calibration parameter calculated in advance and data of the direction (the horizontal angle and the vertical angel) from the camera device 1 to the sound position. Further, the term "calibration" means an operation of calculating or acquiring a predetermined calibration parameter necessary for the directivity direction calculation unit 34*a* of the directivity control apparatus 3 to calculate the directivity direction coordinate ($\theta_{MAh}$, $\theta_{MAv}$).

In the directivity direction coordinate ($\theta_{MAh}$, $\theta_{MAv}$), $\theta_{MAh}$ indicates a horizontal angle in the directivity direction toward the sound position from the installation position of the omnidirectional microphone array device 2 and $\theta_{MAv}$ indicates a vertical angle in the directivity direction toward the sound position from the installation direction of the omnidirectional microphone array device 2. In the description hereinafter, for convenience of description, the reference directions (direction at 0 degree) of respective horizontal angles of the camera device 1 and the omnidirectional microphone array device are assumed to be match.

The output control unit 34*b* as a beam forming unit controls the operations of the display device 35 and the speaker device 36, displays the image data transmitted from the camera device 1 to the display device 35, and outputs the sound data transmitted from the omnidirectional microphone array device 2 to the speaker device 36. Further, the output control unit 34*b* forms the directivity of the sound (or beam) collected by the omnidirectional microphone array device 2 in the directivity direction indicated by the directivity direction coordinate ($\theta_{MAh}$, $\theta_{MAv}$), which is calculated by the directivity direction calculation unit 34*a* using the sound data transmitted from the omnidirectional microphone array device 2.

Figure 4A:
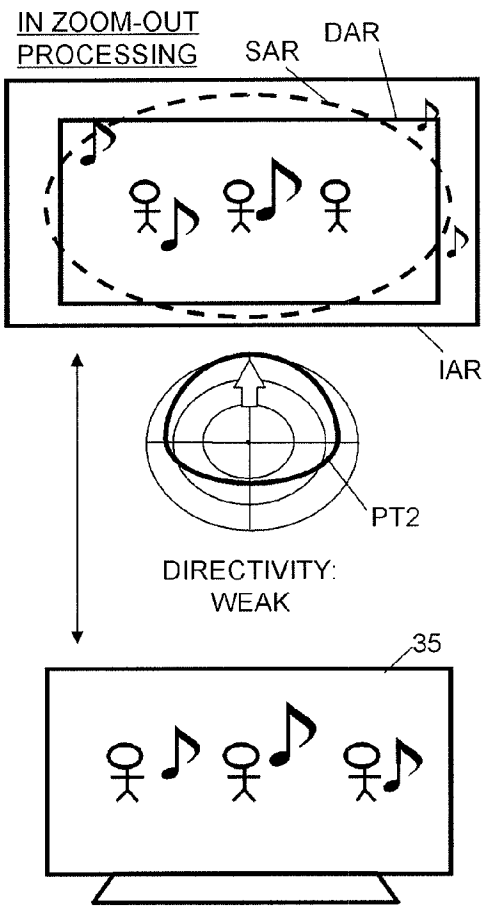
FIG. 4A illustrates a directivity pattern, a display screen, a sound zoom area, and a display area of the display screen in a zoom-out processing.
Figure 4B:
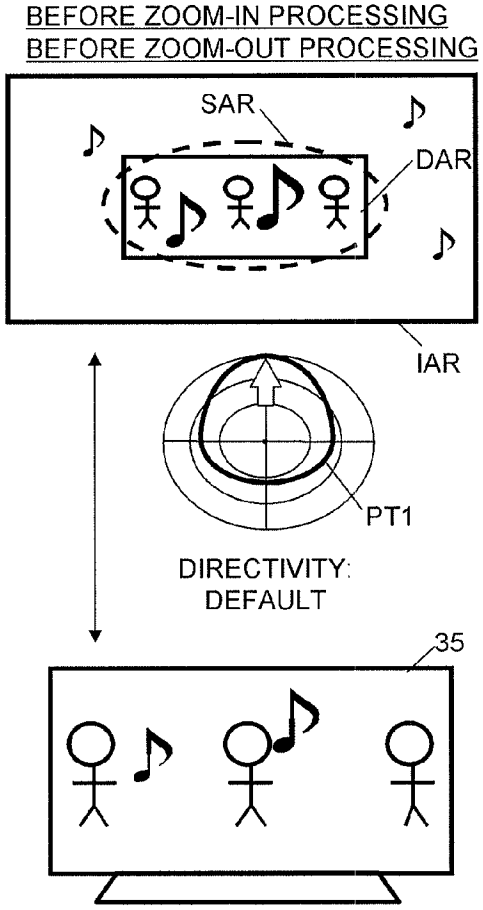
FIG. 4B illustrates the directivity pattern, the display screen, the sound zoom area, and the display area of the display screen before the zoom-out processing and before a zoom-in processing.
Figure 4C:
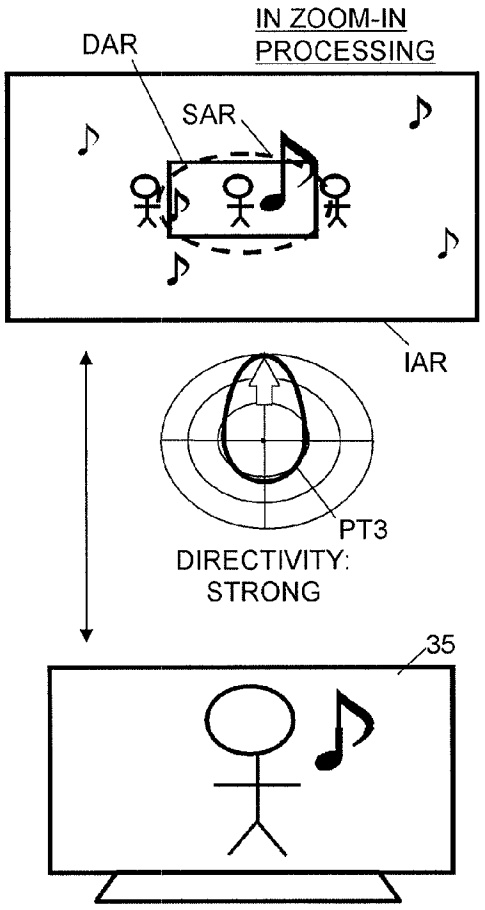
FIG. 4C illustrates the directivity pattern, the display screen, the sound zoom range, and the display area of the display screen in the zoom-in processing.

In addition, in a case in which the zoom-in processing or the zoom-out processing of the image data is performed by the camera device 1, the output control unit 34*b* displays the image data after the zoom-in processing or the zoom-out processing on the display device 35, and re-forms the directivity of the sound data using the width (or size) of the beam in the directivity direction adjusted by a zoom-coordination control unit 34*c* described below. The "size" in this embodiment is not limited to the width of the beam representing the directivity, but may include a longitudinal length of the directivity patterns PT1, PT2 and PT3 as shown in FIGS. 4A, 4B and 4C. Hereinafter, the "width" of the beam may be replaced with the "size" of the beam.

Be doing this, the directivity control apparatus 3 can relatively amplify the volume level of the sound generated by the monitoring target which is present in the directivity direction with the directivity formed therein, and can relatively reduce the volume level by suppressing the sound in the direction with no directivity formed therein.

In a case where the zoom-in processing or the zoom-out processing of the image data is performed by the camera device 1, the zoom-coordination control unit 34*c* as a magnification setting unit adjusts at least either of or both of the directivity formed by the output control unit 34*b* (that is, the width of the beam in the directivity direction) and the volume level of the sound data output from the speaker device 36 using the zoom-in processing. In addition, the amounts of the width of the beam and the volume level to be adjusted may respectively be predetermined values or values according to the information related to the magnification of the zoom-in processing or the zoom-out processing.

Specifically, in a case where the zoom-in processing of the image data is performed by the camera device 1, the zoom-coordination control unit 34*c* adjusts the width of the beam in the directivity direction to be narrow using the information related to the predetermined value or the magnification of the zoom-in processing, and increases the volume level of the sound data (see FIGS. 4B and 4C). FIG. 4B illustrates the directivity pattern PT1, the display screen, the sound zoom area SAR, and the display area DAR of the display screen before the zoom-out operation and before a zoom-in operation. FIG. 4C illustrates a directivity pattern PT3, the display screen, the sound zoom area SAR, and the display area DAR of the display screen at the time of the zoom-in processing.

In contrast, in a case where the zoom-out processing of the image data is performed by the camera device 1, the zoom-coordination control unit 34*c* adjusts the width of the beam in the directivity direction to be great using the information related to the predetermined value or the magnification of the zoom-out processing, and maintains the volume level of the sound data (see FIGS. 4A and 4B). FIG. 4A illustrates a directivity pattern PT2, the display screen, the sound zoom area SAR, and the display area DAR of the display screen at the time of the zoom-out processing.

Hereinafter, a description will be made of a case where the zoom-in processing or zoom-out processing is performed, but the same procedure can be applied to a case where magnifying or demagnifying operation of the image is performed instead of the zoom-in processing or the zoom-out processing. For example, the directivity of the sound may be changed when the image is magnified or demagnified while reproducing the recorded video.

In FIGS. 4A to 4C, the display area DAR of the display screen indicates a display area of the image data displayed on the display device 35 in the angle of view (that is, an area IAR which can be captured) of the camera device 1. In FIG. 4B, the sound zoom area SAR indicates a range on which the directivity of the sound data is formed.

The directivity pattern PT1 shown in FIG. 4B indicates a default state of the directivity (width of the beam in the directivity direction) on which the output control unit 34*b* is formed before the camera device 1 performs the zoom-in processing or the zoom-out processing.

The directivity pattern PT3 shown in FIG. 4C indicates the directivity (width of the beam in the directivity direction) on which the output control unit 34*b* is formed after the camera device 1 performs the zoom-in processing. The directivity pattern PT2 shown in FIG. 4A indicates the directivity (width of the beam in the directivity direction) on which the output control unit 34*b* is formed after the camera device 1 performs the zoom-out processing.

Since the width of the beam in the directivity direction is adjusted to be narrow when the zoom-in processing is performed with respect to the image data of the display device 35 shown in FIG. 4B, the sound zoom area SAR on which the directivity is formed becomes narrow and the strength of the directivity is improved. In this case, the image data after the zoom-in processing, that is, one person reflected on the display area DAR corresponding to the sound zoom area SAR is magnified and displayed on the display device 35, and the volume level of the sound generated by the person is also increased and output.

In contrast, since the width of the beam in the directivity direction is adjusted to be great when the zoom-out processing is performed with respect to the image data of the display device 35 shown in FIG. 4B, the sound zoom area SAR on which the directivity is formed becomes wide and the strength of the directivity is improved. In this case, the image data after the zoom-out processing, that is, three persons reflected on the display area DAR corresponding to the sound zoom area SAR is demagnified and displayed on the display device 35, and the data is output in a state in which the volume level of the sounds generated by these three persons is maintained.

Further, in a case where the zoom-in processing is performed by the camera device 1, the zoom-coordination control unit 34*c* performs the voice change processing on the sound data collected by the omnidirectional microphone array device 2 and outputs the data to the output control unit 34*b*.

The display device 35 as an example of a display unit is formed with, for example, a Liquid Crystal Display (LCD) or organic Electroluminescence (EL) and displays image data captured by the camera device 1 under the control of the output control unit 34*b*.

The speaker device 36 as an example of a sound output unit outputs sound data of the sound collected by the omnidirectional microphone array device 2 or sound data in which the directivity is formed in the directivity direction indicated by the directivity direction coordinate ($\theta_{MAh}$, $\theta_{MAv}$). Further, the display device 35 and the speaker device 36 may have configurations of being separate from the directivity control apparatus 3.

A memory 38 as an example of a memory unit is formed with a Random Access Memory (RAM) and functions as a work memory when respective units of the directivity control apparatus 3 are operated. In addition, the memory 38 may be formed with a hard disk or a flash memory, and stores the image data and the sound data stored in the recorder 4 in this case.

The recorder 4 stores the image data captured by the camera device 1 and the sound data of the sound collected by the omnidirectional microphone array device 2 in an associated manner.

Figure 3:
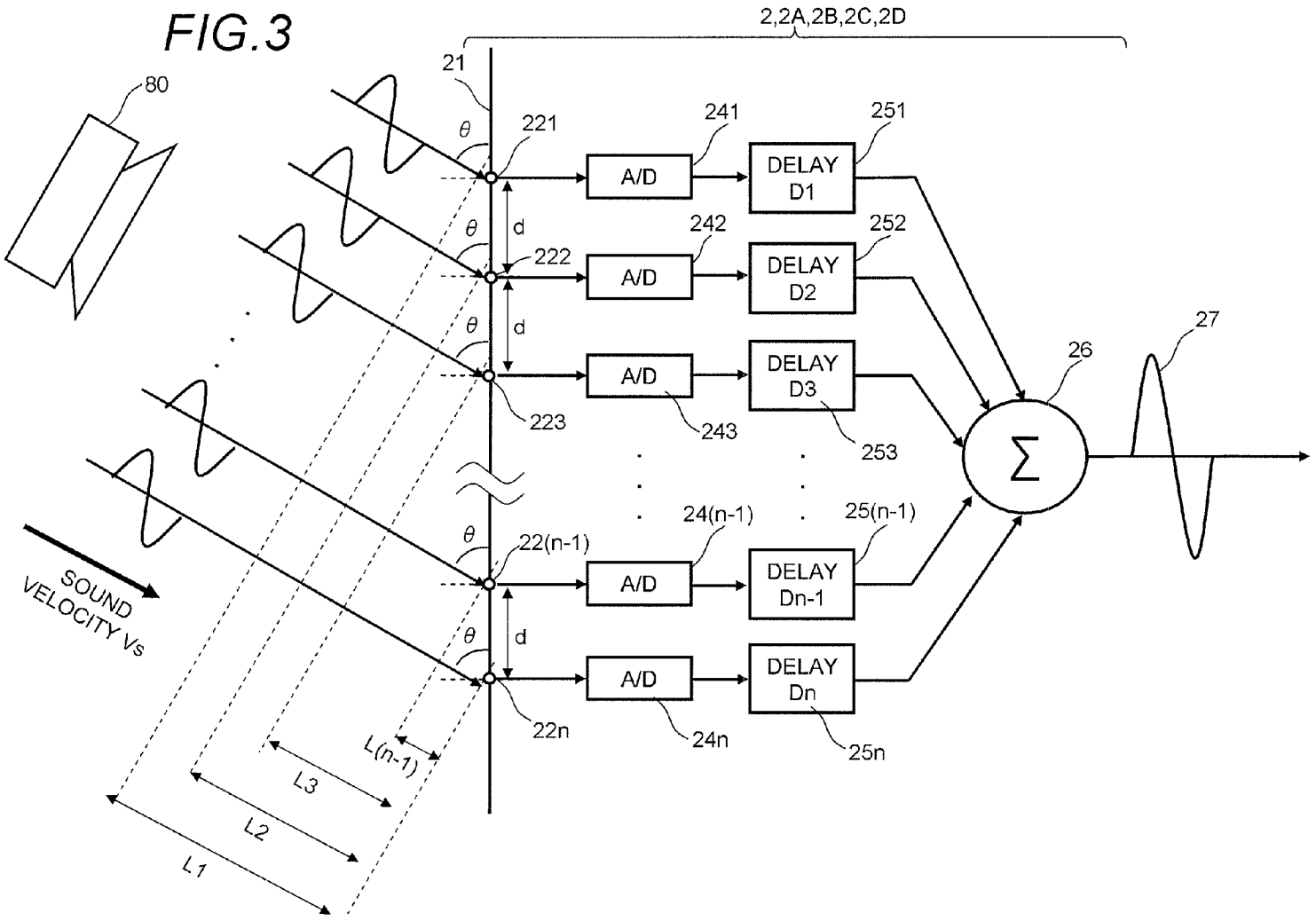
FIG. 3 is a simple explanatory view illustrating a delay-and-sum method in which the omnidirectional microphone array device forms directivity of sound data in a direction θ.

FIG. 3 is a simple explanatory view illustrating a delay-and-sum system in which the omnidirectional microphone array device 2 forms the directivity of sound data in a direction θ. For convenience of description, when assuming that microphone elements 221 to 22*n* are arranged on a straight line, the directivity becomes a two-dimensional area in a plane, but, for forming the directivity in a three-dimensional space, the same processing method may be performed by arranging microphones two-dimensionally.

A sound wave generated from a sound source 80 is incident at a certain angle (incident angle=(90−θ) (degrees)) to respective microphone elements 221, 222, 223, . . . , 22(*n*−1), and 22*n* to be incorporated in microphone units 22 and 23 of the omnidirectional microphone array device 2.

The sound source 80 is, for example, a monitoring target (for example, two persons 91 and 92 shown in FIG. 5A) present in the directivity direction of the omnidirectional microphone array device 2, and is present in the direction at a predetermined angle θ with respect to the surface of the housing 21 of the omnidirectional microphone array device 2. Further, intervals d between respective microphone elements 221, 222, 223, . . . , 22(*n*−1), and 22*n* are set to be constant.

The sound wave generated by the sound source 80 first arrives at the microphone element 221 to be collected and then arrives at the microphone element 222 to be collected. In this manner, the sound is collected by the same processes one after another, and then the sound wave finally arrives at the microphone element 22*n* to be collected.

Moreover, in a case where the sound sources 80 are sounds of monitoring targets (for example, the two persons 91 and 92) at the time of meeting, the direction from the positions of respective microphone elements 221, 222, 223, . . . , 22(*n*−1), 22*n* of the omnidirectional microphone array device 2 toward the sound sources 80 is the same as the direction from respective microphones (microphone element) of the omnidirectional microphone array device 2 toward the sound direction corresponding to the designated position designated in the display device 35 by the observer.

Here, time from the sound source arriving at the microphone elements 221, 222, 223, . . . , 22(*n*−1) in this order to the sound wave finally arriving at the microphone element 22*n*, which are arrival time differences τ1, τ2, τ3, . . . , τ(n−1), are generated. For this reason, in a case where the sound data of the sound collected by the respective microphone elements 221, 222, 223, . . . , 22(*n*−1), and 22*n* are added as they are, the volumes level of the sound wave attenuates each other as a whole because the data is added in a state in which phases are shifted.

Moreover, τ1 is a time difference between the time at which the sound wave arrives at the microphone element 221 and the time at which the sound wave arrives at the microphone element 22*n*, τ2 is a time difference between the time at which the sound wave arrives at the microphone element 222 and the time at which the sound wave arrives at the microphone element 22*n*, and, in the same manner, τ(n−1) is a time difference between the time at which the sound wave arrives at the microphone element 22(*n*−1) and the time at which the sound wave arrives at the microphone element 22*n*.

In the present embodiment, the omnidirectional microphone array device 2 includes A/D converters 241, 242, 243, . . . , 24(*n*−1), and 24*n* corresponding to each of the microphone elements 221, 222, 223, . . . , 22(*n*−1), and 22*n*; delay units 251, 252, 253, . . . , 25(*n*−1), and 25*n*; and an adder 26 (see FIG. 3).

In other words, the omnidirectional microphone array device 2 performs AD conversion of analog sound data collected by respective microphone elements 221, 222, 223, . . . , 22(*n*−1), and 22*n* to digital sound data in A/D converters 241, 242, 243, . . . , 24(*n*−1), and 24*n*.

Moreover, in delay units 251, 252, 253, . . . , 25(*n*−1), and 25*n*, after the omnidirectional microphone array device 2 arranges phases of entire sound waves by applying delay times corresponding to arrival time differences in respective microphone elements 221, 222, 223, . . . , 22(*n*−1), and 22*n*, the sound data is added after the delay processing in the adder 26. By doing this, the omnidirectional microphone array device 2 forms directivity of sound data in respective microphone units 221, 222, 223, . . . , 22(*n*−1), and 22*n* in the direction at a predetermined angle θ.

For example, in FIG. 3, respective delay times D1, D2, D3, . . . , D(n−1), and Dn set in the delay units 251, 252, 253, . . . , 25(*n*−1), and 25*n* correspond to arrival time differences τ1, τ2, τ3, . . . , τ(n−1) respectively, and are expressed by Expression (1).

[Expression 1]

$$D1 = \frac{L1}{Vs} = \frac{\{d \times (n-1) \times \cos\theta\}}{Vs} \quad (1)$$

$$D2 = \frac{L2}{Vs} = \frac{\{d \times (n-2) \times \cos\theta\}}{Vs}$$

$$D3 = \frac{L3}{Vs} = \frac{\{d \times (n-3) \times \cos\theta\}}{Vs}, \ldots,$$

$$Dn-1 = \frac{\mathrm{Ln}-1}{Vs} = \frac{\{d \times 1 \times \cos\theta\}}{Vs}$$

$$Dn = 0$$

L1 is a difference between the sound wave arrival distances of the microphone element 221 and the microphone element 22*n*. L2 is a difference of the sound wave arrival distance between the microphone element 222 and the microphone element 22*n*. L3 is a difference of the sound wave arrival distance between the microphone element 223 and the microphone element 22*n*, and, in the same manner, L(n−1) is a difference of the sound wave arrival distance between the microphone element 22(*n*−1) and the microphone element 22*n*. Vs is the velocity of the sound wave (sound velocity). L1, L2, L3, . . . , L(n−1) and Vs are known values. In FIG. 3, the delay time Dn set in the delay unit 25*n* is 0 (zero).

In this way, the omnidirectional microphone array device 2 can easily form the directivity of the sound data of the sound collected by respective microphone elements 221, 222, 223, . . . , 22(*n*−1), and 22*n* incorporated in the microphone units 22 and 23 by changing the delay times D1, D2, D3, . . . , Dn−1, and Dn set in the delay units 251, 252, 253, . . . , 25(*n*−1), and 25*n*.

Moreover, the description of the forming processing of the directivity shown in FIG. 3 is made on the premise that the processing is performed by the omnidirectional microphone array device 2 for convenience of description, provided that the output control unit 34*b* of the signal processing unit 34 of the directivity control apparatus 3 may perform the forming process of the directivity as shown in FIG. 3 using the sound data of the sound collected by the respective microphone elements of the omnidirectional microphone array device 2 in a case where the output control unit 34*b* of the signal processing unit 34 of the directivity control apparatus 3 has the same number of AD converters 241 to 24*n* and delay units 251 to 25*n* as the number of microphones of the omnidirectional microphone array device 2, and one adder 26.

Figure 5A:
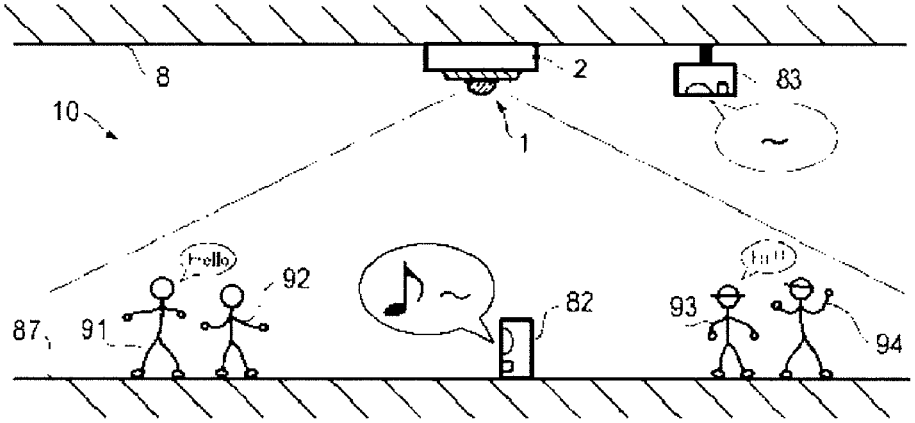
FIG. 5A illustrates a monitoring range in which an omnidirectional microphone array device 2 and a camera device 1 integrally incorporated are attached to a ceiling surface of an indoor hall.
Figure 5B:
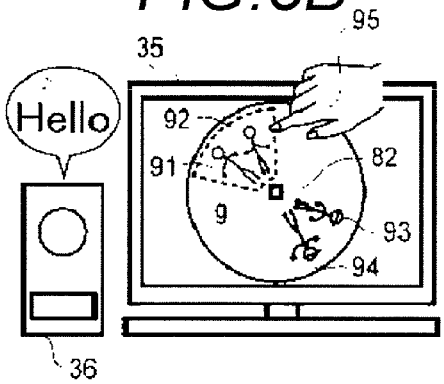
FIG. 5B illustrates a selection operation of a range g containing two persons 91 and 92 in omnidirectional image data.
Figure 5D:
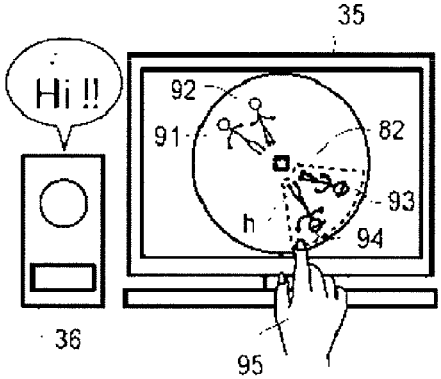
FIG. 5D illustrates the selection operation of a range h containing two persons 93 and 94 in the omnidirectional image data.
Figure 5C:
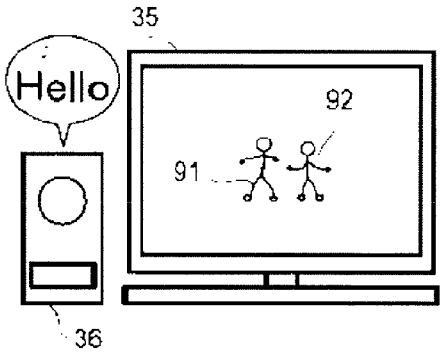
FIG. 5C illustrates a state in which image data of the two persons 91 and 92 after a distortion correction processing is displayed on a display device and sound data of conversation between the persons 91 and 92 is output from a speaker device.
Figure 5E:
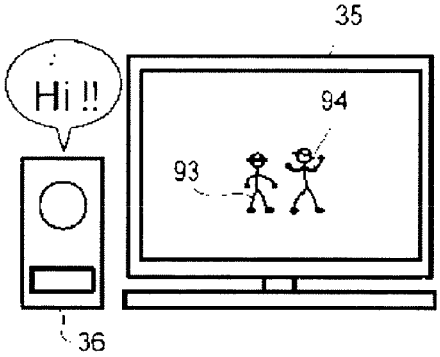
FIG. 5E illustrates a state in which image data of the two persons 93 and 94 after the distortion correction processing is displayed on the display device and sound data of conversation between the persons 93 and 94 is output from the speaker device.

FIG. 5A illustrates a monitoring range in which an omnidirectional microphone array device 2 and a camera device 1 integrally incorporated are attached to the ceiling surface 8 of an indoor hall, FIG. 5B illustrates a selection operation of a range g containing the two persons 91 and 92 in omnidirectional image data, FIG. 5C illustrates a state in which image data of the two persons 91 and 92 after a distortion correction processing is displayed on the display device 35 and sound data of conversation between the persons 91 and 92 is output from the speaker device 36, FIG. 5D illustrates the selection operation of a range h containing two persons 93 and 94 in the omnidirectional image data, and FIG. 5E illustrates a state in which image data of the two persons 93 and 94 after the distortion correction processing is displayed on the display device 35 and sound data of conversation between the persons 93 and 94 is output from the speaker device 36.

FIG. 5A illustrates a state in which the doughnut-like omnidirectional microphone array device 2, the camera device 1 integrally formed with the omnidirectional microphone array device 2, and the speaker device 83 are disposed on the ceiling surface 8 of an event hall. Further, in FIG. 5A, the two persons 91 and 91 have a conversation with each other and the two persons 93 and 94 have a conversation with each other, and the speaker device 82 outputs the sound data of a predetermined piece of music (for example, BGM).

In FIG. 5B, image data (omnidirectional image data) related to all directions of the sound collection range captured by the camera device 1 is displayed on the display screen of the display device 35. The observer attempts to touch and drag the vicinity of the upper left side (specifically, the range of the symbol g) of the image data of four persons 91, 92, 93, and 94 displayed on the display screen of the display device 35 with the finger 95. The camera device 1 acquires the coordinate data showing the range designated by the touch and the drag of the finger 95 from the directivity control apparatus 3, and generates plane image data by performing distortion correction processing on the omnidirectional image data such that the range of the symbol g becomes the center thereof and performing panorama conversion, and then transmits the plane image data to the directivity control apparatus 3. The range of the symbol g is automatically generated from a touch point by the finger 95.

In FIG. 5C, the plane image data generated by the camera device 1 is displayed on the display device 35. In a case where the range of the symbol g is designated by the touch and the drag of the finger 95, since the output control unit 34*b* forms the directivity of the sound data in the direction toward the sound position corresponding to the center position of the range of the symbol g from the omnidirectional microphone array device 2, the volume level of the conversation sounds (Hello) of the two persons 91 and 92 is increased further than the volume level of the surrounding sound and then the data is output (see FIGS. 5B and 5C). In contrast, a piece of music (see "♪~ ~" (musical note) shown in FIG. 5A) output by the speaker device 82 which is disposed at a position closer to the omnidirectional microphone array device 2 than the distance from the two persons 91 and 92, but is not included in the range of the symbol g designated by the observer is not emphasized to be output from the speaker device 36, but is output at a volume level lower than the volume level of the conversation sound of the two persons 91 and 92.

In FIG. 5D, in the same manner as FIG. 5B, image data (omnidirectional image data) related to all directions of the sound collection range captured by the camera device 1 is displayed on the display screen of the display device 35. The observer attempts to touch and drag the vicinity of the lower right side (specifically, the range of the symbol h) of the image data of four persons 91, 92, 93, and 94 displayed on the display screen of the display device 35 with the finger 95. The camera device 1 acquires the coordinate data showing the range designated by the touch and the drag of the finger 95 from the directivity control apparatus 3, and generates plane image data by performing distortion correction processing on the omnidirectional image data such that the range of the symbol h becomes the center thereof and performing panorama conversion, and then transmits the plane image data to the directivity control apparatus 3.

In FIG. 5E, the plane image data generated by the camera device 1 is displayed on the display device 35. In a case where the range of the symbol h is designated by the touch and the drag of the finger 95, since the output control unit 34*b* forms the directivity of the sound data in the direction toward the sound position corresponding to the center position of the range of the symbol g, the volume level of the conversation sound (Hi!!) of the two persons 93 and 94 is increased further than the volume level of the surrounding sound and then the data is output (see FIGS. 5D and 5E). In contrast, a piece of music (see "♪~ ~" (musical note) shown in FIG. 5A) output by the speaker device 82 which is disposed at a position closer to the omnidirectional microphone array device 2 than the distance from the two persons 93 and 94, but is not included in the range of the symbol h designated by the observer is not emphasized to be output from the speaker device 36, but is output at a volume level lower than the volume level of the conversation sound of the two persons 93 and 94. The range of the symbol h is automatically generated from a touch point by the finger 95.

Figure 6:
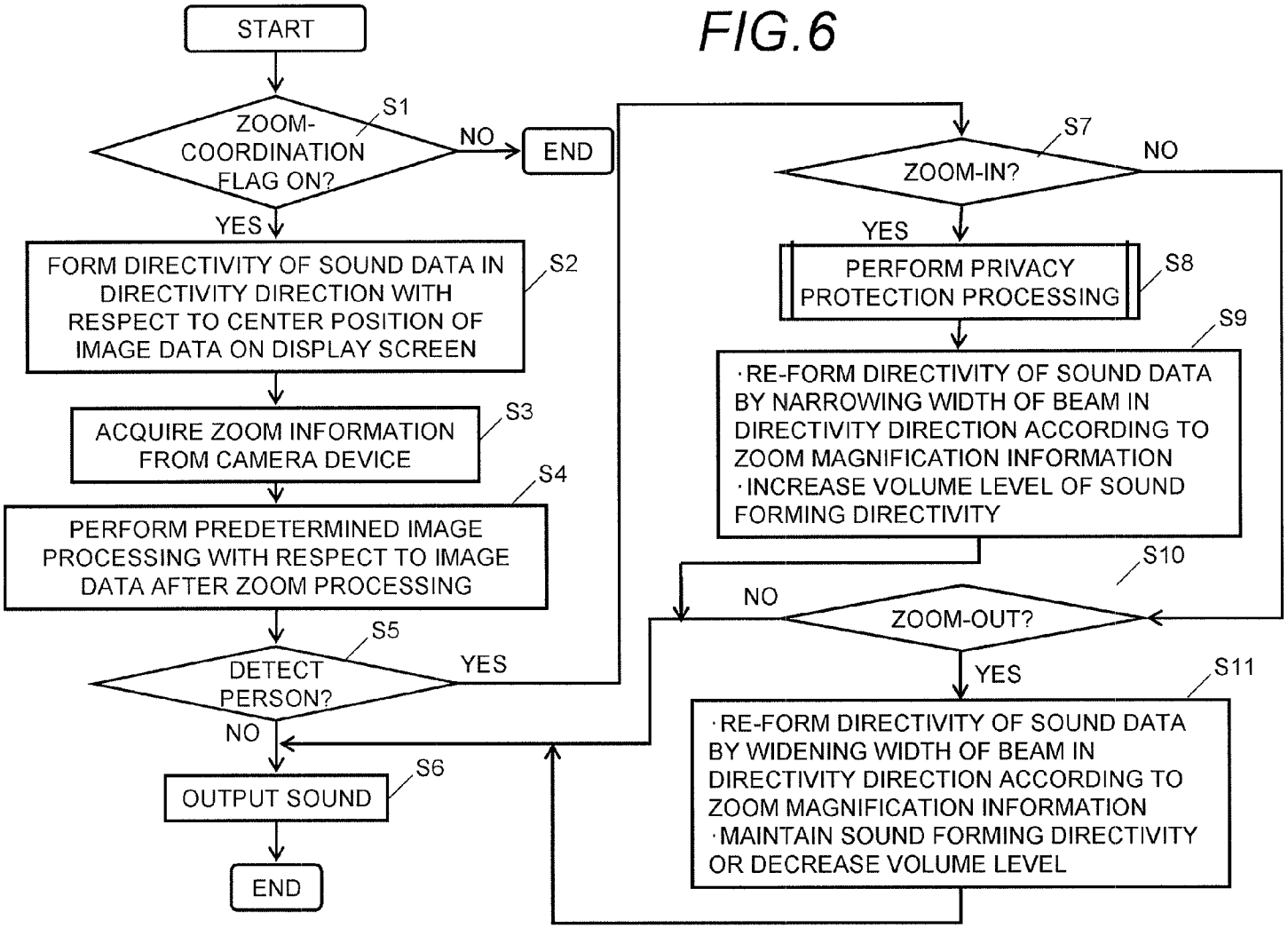
FIG. 6 is a flowchart specifically describing operation procedures of a directivity control apparatus according to the first embodiment.

Next, detailed operation procedures of the directivity control system 10 of the present embodiment will be described with reference to FIG. 6. FIG. 6 is a flowchart specifically describing operation procedures of the directivity control apparatus 3 according to the first embodiment. The description of the directivity control apparatus 3 in FIG. 6 is made on the premise that an arbitrary position in the image data displayed on the display device 35 is designated by the finger 95 of the observer and the directivity direction from the omnidirectional microphone array device 2 toward the sound position in the real space corresponding to the designated position of the finger 95 is calculated.

In FIG. 6, the zoom-coordination control unit 34*c* determines whether a zoom-coordination flag indicating whether to adjust the volume level and the directivity (width in the directivity direction) of the sound data is on by coordinating the zoom-in processing or the zoom-out processing of the camera device 1 (S1). The zoom-coordination control unit 34*c* determines whether the zoom-coordination flag is on by storing the content of the zoom-coordination flag in the zoom-coordination control unit 34 itself or the memory 37. When it is determined that the zoom-coordination flag is off (S1, No), the operation of the directivity control apparatus 3 shown in FIG. 6 ends.

In contrast, when it is determined that the zoom-coordination flag is on (S1, Yes), the output control unit 34*b* forms the directivity of the sound data in the directivity direction from the omnidirectional microphone array device 2 toward the sound position in the real space corresponding to the designated position in the image data displayed on the display device 35 (S2).

Subsequent to Step S2, it is assumed that the zoom-in processing or the zoom-out processing of the image data displayed on the display device 35 is instructed to be performed by the periodic timing of the camera device 1 or the input operation of the observer. The camera device 1 performs the zoom-in processing or the zoom-out processing of the image data displayed on the display device 35 according to the execution instruction of the zoom-in processing or the zoom-out processing. The camera device 1 transmits the information related to the magnification of the zoom-in processing or the zoom-out processing and the image data after the zoom-in processing or the zoom-out processing to directivity control apparatus 3 via the network NW after the zoom-in processing or the zoom-out processing. The zoom-coordination control unit 34*c* acquires the information (zoom information) related to the magnification of the zoom-in processing or the zoom-out processing and the image data after the zoom-in processing or the zoom-out processing from the communication unit 31.

The zoom-coordination control unit 34*c* performs a predetermined image processing on the image processing unit 33 using the image data after the zoom-in processing or the zoom-out processing. The image processing unit 33 performs the predetermined image processing (for example, face detection of a person or motion detection of a person) with respect to the image data after the zoom-in processing or the zoom-out processing which is displayed on the display device 35, and outputs the results of the image processing to the zoom-coordination control unit 34*c* (S4).

In a case where a person is undetected in the image data after the zoom-in processing or the zoom-out processing, which is displayed on the display device 35 (S5, NO) from the results of the imaging processing in Step S4, the zoom-coordination control unit 34*c* determines that the directivity of the sound data is maintained without adjustment regardless of the zoom-in processing or the zoom-out processing and the volume level of the sound data is maintained without adjustment. The output control unit 34*b* outputs the sound data collected by the omnidirectional microphone array device 2 in a state in which the directivity of the sound data before the zoom-in processing or the zoom-out processing is maintained (S6). Subsequent to Step S6, the operation of the directivity control apparatus 3 shown in FIG. 6 ends.

In contrast, in a case where a person is detected in the image data after the zoom-in processing or the zoom-out processing, which is displayed on the display device 35 from the results of the image processing in Step S4 (S5, YES), the zoom-coordination control unit 34*c* determines whether the zoom-in processing is performed by the camera device 1 based on the information related to the magnification of the zoom-in processing or the zoom-out processing acquired in Step S3 (S7).

In a case where it is determined that the zoom-in processing is performed by the camera device 1 (S7, YES), the zoom-coordination control unit 34*c* performs a predetermined privacy protection processing related to the image and the sound (S8). Here, the operation of the predetermined privacy protection processing will be described with reference to FIGS. 7A, 7B, 8A, 8B, and 8C.

Figure 7B:
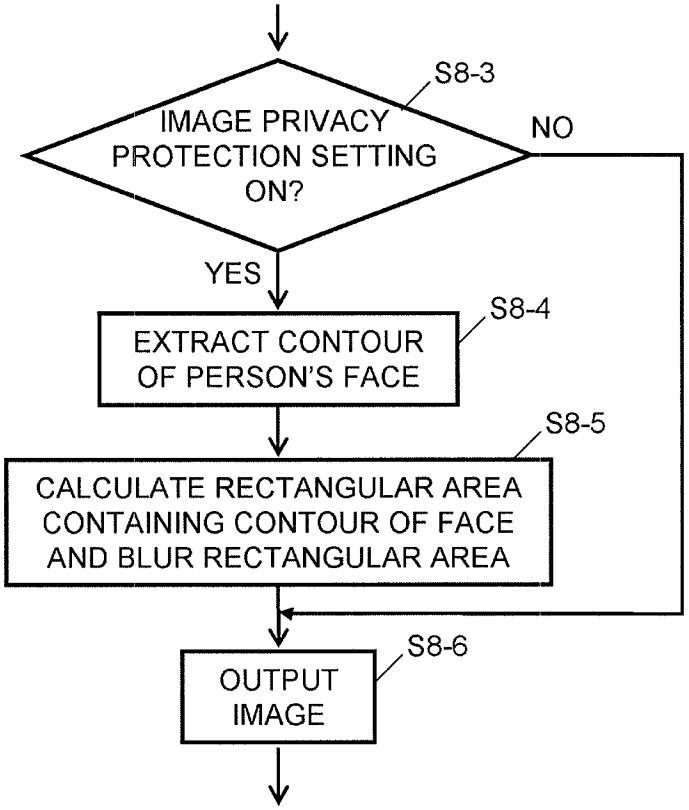
FIG. 7B is a flowchart describing operation procedures of the image privacy protection processing as a second example of the privacy protection processing shown in FIG. 6.
Figure 7A:
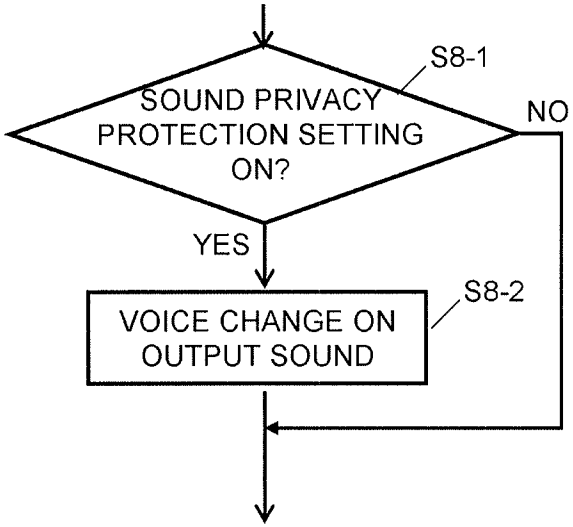
FIG. 7A is a flowchart describing operation procedures of a sound privacy protection processing as a first example of the privacy protection processing shown in FIG. 6.
Figure 8C:
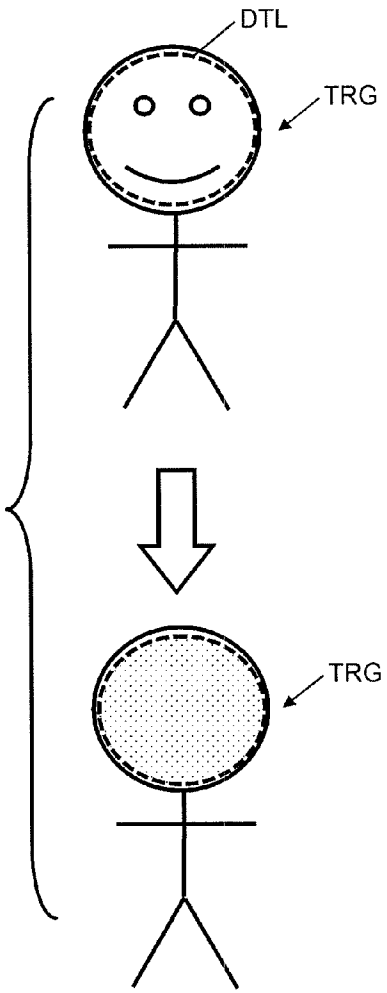
FIG. 8C is an explanatory view describing a vignetting processing in a contour of a detected person's face.
Figure 8A:
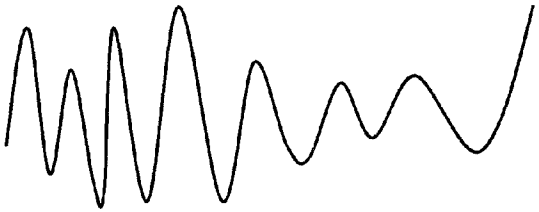
FIG. 8A illustrates an example of a waveform of a sound signal corresponding to a pitch before a voice change processing.
Figure 8B:
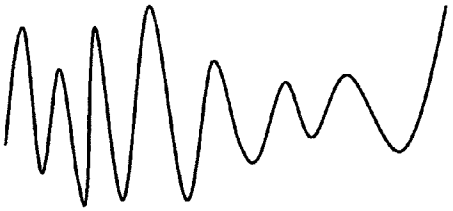
FIG. 8B illustrates an example of the waveform of the sound signal corresponding to the pitch after the voice change processing.

FIG. 7A is a flowchart describing operation procedures of a sound privacy protection processing as a first example of the privacy protection processing shown in FIG. 6. FIG. 7B is a flowchart describing operation procedures of the image privacy protection processing as a second example of the privacy protection processing shown in FIG. 6. FIG. 8A illustrates an example of a waveform of a sound signal corresponding to a pitch before a voice change processing. FIG. 8B illustrates an example of the waveform of the sound signal corresponding to the pitch after the voice change processing. FIG. 8C is an explanatory view describing a vignetting processing in a contour of a detected person's face. Further, in the description of the predetermined privacy protection processing related to the image and the sound, the description is made by dividing a diagram into the image privacy protection processing shown in FIG. 7A and the sound privacy protection processing shown in FIG. 7B for convenience of description, but the directivity control apparatus 3 may continuously perform the operation shown in FIG. 7A and the operation shown in FIG. 7B.

In FIG. 7A, the zoom-coordination control unit 34*c* determines whether the sound privacy protection setting is on (S8-1). The zoom-coordination control unit 34*c* determines whether the sound privacy protection setting is on by storing the content of the sound privacy protection setting in the zoom-coordination control unit 34*c* itself or in the memory 37. In a case where the zoom-coordination control unit 34*c* determines that the sound privacy protection setting is off (S8-1, No), the sound privacy protection processing shown in FIG. 7A ends.

In contrast, in a case where the zoom-coordination control unit 34*c* determines that the sound privacy protection setting is on (S8-1, YES), the zoom-coordination control unit 34*c* performs the voice change processing with respect to the sound data output from the speaker device 36 after the image data displayed on the display device 35 is subjected to the zoom-in processing (S8-2). Subsequent to Step S8-2, the sound privacy protection processing shown in FIG. 7A ends.

As an example of the voice change processing, the zoom-coordination control unit 34*c* increases or decreases the pitch of waveforms of the sound data of the sound collected by the omnidirectional microphone array device 2 or the sound data with the directivity formed therein by the output control unit 34*b* (for example, see FIGS. 8A and 8B). In this way, the zoom-coordination control unit 34*c* can effectively protect the privacy of a changed monitoring target (for example, a person) changed by the zoom-in processing by making it difficult for the sound collected by the omnidirectional microphone array device 2 or the sound data in which the directivity is formed to be recognized that who owns the sound.

Further, in FIG. 7B, the zoom-coordination control unit 34*c* determines whether the image privacy protection setting is on (S8-3). The zoom-coordination control unit 34*c* determines whether the image privacy protection setting is on by storing the content of the image privacy protection setting in the zoom-coordination control unit 34*c* itself or the memory 37. In the case where the zoom-coordination control unit 34*c* determines that the image privacy protection setting is off (S8-3, NO), the output control unit 34*b* displays the image data after the zoom-in processing on the display device 35 (S8-6).

In contrast, in a case where the zoom-coordination control unit 34*c* determines that the image privacy protection setting is on (S8-3, YES), the image processing unit 33 detects (extracts) a contour DTL of a face of a new monitoring target (for example, a person TRG) displayed on the display area of the display device 35 after the zoom-in processing according to the instruction of the zoom-coordination control unit 34*c* (S8-4), and performs the masking processing on the contour DTL of the face (S8-5). Specifically, the image processing unit 33 calculates a rectangular area including the contour DTL of the detected face and performs a predetermined vignetting processing in the rectangular area (see FIG. 8C). The image processing unit 33 outputs the image data generated by the vignetting processing to the output control unit 34*b*.

In this way, the image processing unit 33 can effectively protect the privacy of the object on the image by making it difficult for the object (for example, a specific person) serving as a changed monitoring target after the zoom-in processing to be recognized who the object is. The output control unit 34*b* displays the image data as it is after the zoom-in processing on the display device 35 (S8-6). Subsequent to Step S8-6, the image privacy protection processing shown in FIG. 7B ends.

In FIG. 6, the zoom-coordination control unit 34*c* adjusts the width of the beam in the directivity direction to be narrow and increases the volume level of the sound data using the information related to the known values or the magnification of the zoom-in processing after the privacy protection processing is performed in Step 8 (S9). Further, the output control unit 34*b* re-forms the directivity of the sound data according to the width of the beam in the directivity direction after the adjustment by the zoom-coordination control unit 34*c* (S9). Subsequent to Step S9, the operation of the directivity control apparatus 3 advances to Step S6.

In contrast, in a case where the zoom-coordination control unit 34*c* determines that the zoom-out processing is performed by the camera device 1 (S10, YES), the zoom-coordination control unit 34*c* adjusts the width of the beam in the directivity direction to be great and maintains the volume level of the sound data or decrease the volume level if the current volume level is large enough using the information related to the known values or the magnification of the zoom-out processing (S11). Further, the output control unit 34*b* re-forms the directivity of the sound data according to the width of the beam in the directivity direction after the adjustment by the zoom-coordination control unit 34*c* (S11). Subsequent to Step S11, the operation of the directivity control apparatus 3 advances to Step S6.

By doing this, in the directivity control system 10 of the present embodiment, since the directivity control apparatus 3 adjusts the strength of the directivity of the sound data (that is, the width of the beam in the directivity direction) according to the zoom processing and re-forms the directivity along with the width of the beam after the adjustment when the object serving as a monitoring target is changed by the zoom processing of the camera device 1 with respect to the monitoring target (for example, a person) displayed on the display device 35, the directivity of the sound data with respect to the object serving as a changed monitoring target is appropriately formed and the deterioration of efficiency of a monitoring task performed by an observer can be suppressed.

For example, since the directivity control apparatus 3 can adjust the width of the beam in the directivity direction to be narrow and can output the sound generated by the object (for example, a specific person) serving as a changed monitoring target such that the sound is distinguished from the surrounding sound of the object, the efficiency of the monitoring task performed by the observer can be improved.

Moreover, for example, since the directivity control apparatus 3 can adjust the width of the beam in the directivity direction to be great and can comprehensively output the sound generated by the object serving as a changed monitoring target (for example, plural persons) in a case where the zoom processing of the image data is the zoom-out processing, the efficiency of the monitoring task performed by the observer can be improved.

In addition, since the directivity control apparatus determines whether to adjust the volume level of the sound data in a case where the object serving as a monitoring target is changed by the zoom processing with respect to the monitoring target, the sound can be output without a sense of discomfort with the size of the display area of the display unit serving as a changed monitoring target according to the content of the zoom processing.

For example, since the directivity control apparatus 3 can increase the volume level of the sound data and can output the sound generated by the object serving as a changed monitoring target (for example, a specific person) with a volume higher than the surrounding sound of the object in a case where the zoom processing of the image data is the zoom-in processing, the efficiency of the monitoring task performed by the observer can be improved.

Further, for example, since the directivity control apparatus 3 can maintain the volume level of the sound data even when the zoom processing of the image data is the zoom-out processing, the directivity control apparatus 3 can output the sound generated by the object (for example, plural persons) serving as a changed monitoring target such that the sound becomes equivalent to the surrounding sound of the object and performs the monitoring task without a sense of discomfort of the observer even by the zoom-out processing.

In addition, since the directivity control apparatus 3 maintains the width of the beam in the directivity direction in a case where the image processing unit determines that a person is not detected in the image data, a sense of discomfort that the environmental sound in the periphery of the sound collection area fluctuates in a state in which a person is not reflected can be eliminated without adjusting the strength of the directivity of the sound data when a person is not detected in the image data.

Second Embodiment

In the directivity control system 10 of the first embodiment, the directivity control apparatus 3 adjusts the width of the beam in the directivity direction to be narrow or wide according to the zoom-in processing or the zoom-out processing of the camera device 1, and increases the volume level of the sound data when the zoom-in processing is performed.

In contrast, in the directivity control system 10 according to the first embodiment, since the number of arrangements of the microphones incorporated in the omnidirectional microphone array device 2 is known, a case in which the strength of the sound data in the directivity direction is not enough can be considered depending on the environment of the sound collection range even when the width of the beam in the directivity direction or the volume level is adjusted.

Here, in a second embodiment, in the case where the width of the beam in the directivity direction or the volume level is adjusted according to the zoom-in processing or the zoom-out processing but the strength of the sound data in the directivity direction is not enough, the directivity control system in which an expansion microphone unit is coupled onto the periphery of the omnidirectional microphone array device 2 will be described. In the system configurations of the directivity control system of the second embodiment, since the configurations other than the expansion microphone unit described below are the same as those of the directivity control system 10 according to the first embodiment, the description related to the same content will be simply described or omitted, and the content different from that of the directivity control system 10 of the first embodiment will be described.

Figure 9:
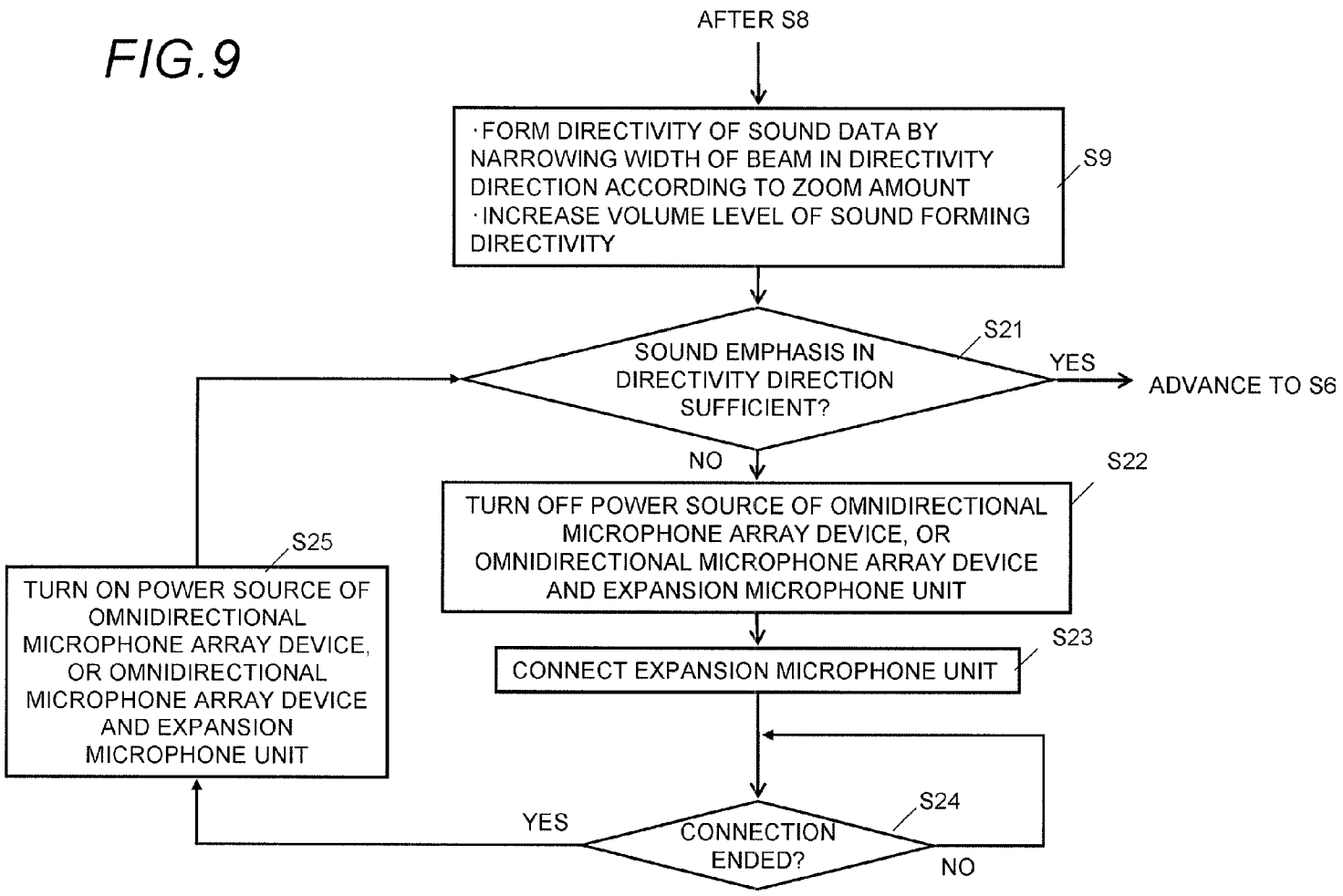
FIG. 9 is a flowchart describing operation procedures which are different from the operation procedures of the directivity control apparatus according to the first embodiment from among the operation procedures of a directivity control apparatus according to a second embodiment.

Next, operation procedures of a directivity control apparatus 3 according to the present embodiment will be described with reference to FIG. 9. FIG. 9 is a flowchart describing operation procedures which are different from the operation procedures of the directivity control apparatus 3 according to the first embodiment from among the operation procedures of the directivity control apparatus 3 according to a second embodiment. In the description of the operation procedures of the directivity control apparatus 3 according to the present embodiment, operation procedures which are different from the operation procedures of the directivity control apparatus 3 according to the first embodiment will be described. As the premise of the description of FIG. 9, the start of FIG. 9 indicates a state before the expansion microphone unit being coupled onto the periphery of the omnidirectional microphone array device 2.

In FIG. 9, the zoom-coordination control unit 34*c* adjusts the width of the beam in the directivity direction to be narrow using the information related to the known values and the magnification of the zoom-in processing and increases the volume level of the sound data after the zoom-coordination control unit 34*c* performs the privacy protection processing in Step 8 (S9). Further, the output control unit 34*b* re-forms the directivity of the sound data according to the width of the beam in the directivity direction after the adjustment by the zoom-coordination control unit 34*c* (S9).

Subsequent to Step S9, the zoom-coordination control unit 34*c* inquires of the observer whether the sound strength of the sound data output by the volume level of the sound data after the directivity in Step S9 is re-formed or adjusted is sufficient (S21). For example, the zoom-coordination control unit 34*c* displays a pop-up screen for inquiring whether the sound strength is sufficient on the display device 35 and receives an input operation of answers to the inquiry performed by the observer. In a case where an answer given by an observer that the sound strength is sufficient is input (S21, YES), the operation of the directivity control apparatus 3 advances to Step S6.

In contrast, in a case where an answer given by an observer that the sound strength is not sufficient is input (S21, NO), since the sound strength in the directivity direction is not sufficient in the current configuration of the directivity control system 10 provided with the omnidirectional microphone array device 2, the expansion microphone unit is newly coupled onto the periphery of the omnidirectional microphone array device 2 (S23) according to the attaching method described below after the power source of the omnidirectional microphone array device 2 or the omnidirectional microphone array device 2 and the expansion microphone unit is turned off (S22). In a case where the coupling of the expansion microphone unit with respect to the periphery of the omnidirectional microphone array device 2 ends (S24, YES), the power source of the omnidirectional microphone array device 2 or the omnidirectional microphone array device 2 and the expansion microphone unit is turned off (S25). Subsequently, the zoom-coordination control unit 34*c* again inquires of the observer whether the sound strength of the sound data output by the volume level of the sound data after the directivity in Step S9 is re-formed or adjusted is sufficient (S21).

Hereinafter, various expansion microphone units coupled onto the periphery of the omnidirectional microphone array device 2 as a first sound collecting unit according to the present embodiment will be described with reference to the drawings.

Figure 10A:
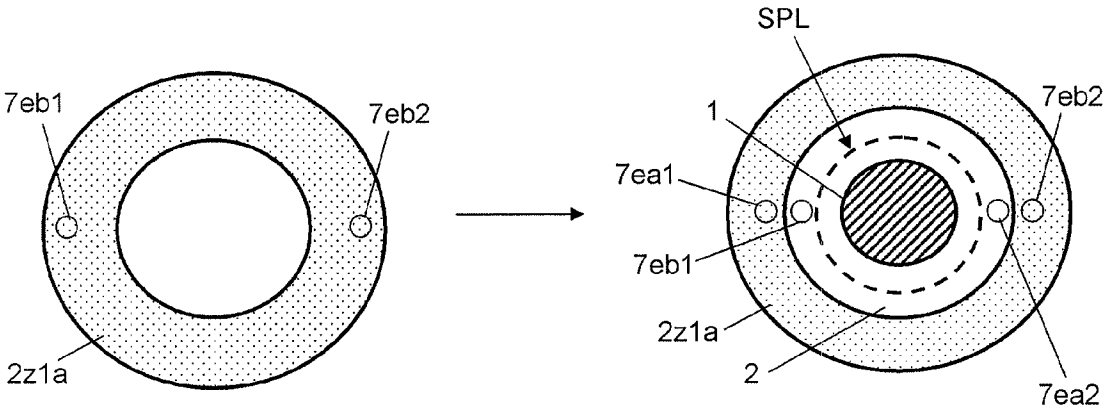
FIG. 10A is a front view illustrating a first example (doughnut-like coupling) of coupling an expansion microphone unit onto the periphery of the omnidirectional microphone array device.
Figure 10B:
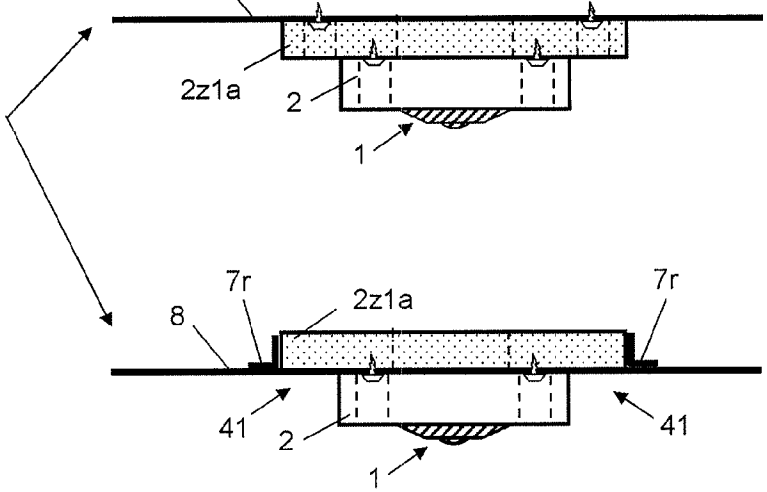
FIG. 10B is a side view illustrating the first example of coupling the expansion microphone unit onto the periphery of the omnidirectional microphone array device.

FIG. 10A is a front view illustrating a first example (doughnut-like coupling) of coupling an expansion microphone unit 2*z*1 onto the periphery of the omnidirectional microphone array device 2. FIG. 10B is a side view illustrating the first example of coupling the expansion microphone unit 2*z*1 onto the periphery of the omnidirectional microphone array device 2.

In FIG. 10A, as the first example of the expansion microphone unit as an example of a second sound collecting unit, an expansion microphone unit 2*z*1 which includes an opening to surround the periphery of the omnidirectional microphone array device 2 and a housing (doughnut-like housing) which is concentrically arranged with the omnidirectional microphone array device 2 is shown. Specifically, the expansion microphone unit 2*z*1 and the omnidirectional microphone array device 2 are separately disposed in the height direction (vertical direction) without being coupled to each other on the same plane as shown in FIG. 10B.

The coupling method is performed by releasing the omnidirectional microphone array device 2 and the camera device 1 from the ceiling surface 8, attaching the expansion microphone unit 2*z*1 to the ceiling surface 8 to be fixed by a screw 41 through screw holes 7*eb*1 and 7*eb*2, attaching the omnidirectional microphone array device 2 separately from the expansion microphone unit 2*z*1 in the height direction, and fixing the omnidirectional microphone array device 2 and the expansion microphone unit 2*z*1 by the screw 41 through the screw holes 7*eb*1 and 7*eb*2. Further, the omnidirectional microphone array device 2, the camera device 1, and the expansion microphone unit 2*z*1 may be attached to the ceiling surface 8 so as to be fixed thereto and may respectively be fixed by the screw 41 through the screw holes 7*eb*1 and 7*eb*2. It is preferable that the housing of the expansion microphone unit 2*z*1 is fixed on the ceiling surface 8 by use of a ceiling-mount metal fitting 7*r*. In addition, it is also preferable that the screw holes 7*eb*1 and 7*eb*2 provided in the housing of the omnidirectional microphone array device 2 are disposed at a position outside a margin line SPL indicated in FIG. 10A. Although the description is made of the coupling method in which the expansion microphone unit 2*z*1 is fixed by use of the screw 41 as an example, other known engaging or fixing structure may be adopted. The same applies hereinafter.

Accordingly, by the coupling of the expansion microphone unit 2*z*1 shown in FIG. 10A, the directivity control system 10 of the present embodiment can further and equally improve the sound collection properties of the sound with respect to all directions when compared to the sound collection properties of the sound when the omnidirectional microphone array device 2 is used alone by uniformly arranging plural microphone elements on the circumference of the expansion microphone unit 2*z*1. In addition, the directivity control system 10 can improve sound collection performance in the vertical direction because the omnidirectional microphone array device 2 and the expansion microphone unit 2*z*1 are separately disposed in the height direction.

Figure 11:
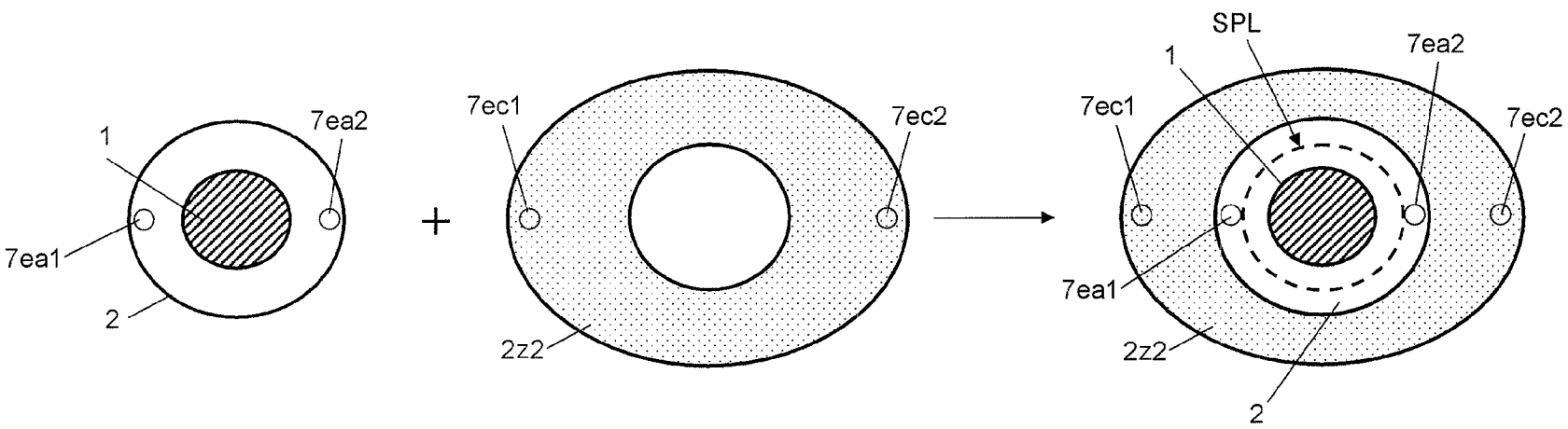
FIG. 11 is a front view illustrating a second example (doughnut elliptic coupling) of coupling the expansion microphone unit onto the periphery of the omnidirectional microphone array device.

FIG. 11 is a front view illustrating a second example (doughnut elliptic coupling) of coupling the expansion microphone unit 2*z*2 onto the periphery of the omnidirectional microphone array device 2.

In FIG. 11, as the second example of the expansion microphone unit, the expansion microphone unit 2*z*2 which includes an opening to surround the periphery of the omnidirectional microphone array device 2 and the elliptic housing is shown. The attaching method of the expansion microphone unit 2*z*2 includes fixing by the screw 41 through screw holes 7*ec*1 and 7*ec*2, and other description (for example, the fixing method of the omnidirectional microphone array device 2 and the camera device 1, and the screw holes 7*ea*1 and 7*ea*2 disposed outside the margin line SPL. The same applies below) is the same as that of the attaching method of the expansion microphone unit 2*z*1 shown in FIG. 10B, so the description will not be repeated.

Accordingly, by the coupling of the expansion microphone unit 282 shown in FIG. 11, the directivity control system 10 of the present embodiment can arrange more microphone elements in the longitudinal direction of the elliptic shape of the expansion microphone unit 2*z*2 than the direction other than the longitudinal direction of the elliptic shape, can uniformly improve the sound collection properties of the sound when compared to the sound collection properties of the sound when the omnidirectional microphone array device 2 is used alone, and can further improve the sound collection properties of the sound with respect to the longitudinal direction of the elliptic shape. Further, since the omnidirectional microphone array device 2 and the expansion microphone unit 2*z*2 are disposed separately from each other in the height direction, the directivity control system 10 can improve the sound collection performance in the vertical direction (perpendicular direction).

Figures 12A, 12B:
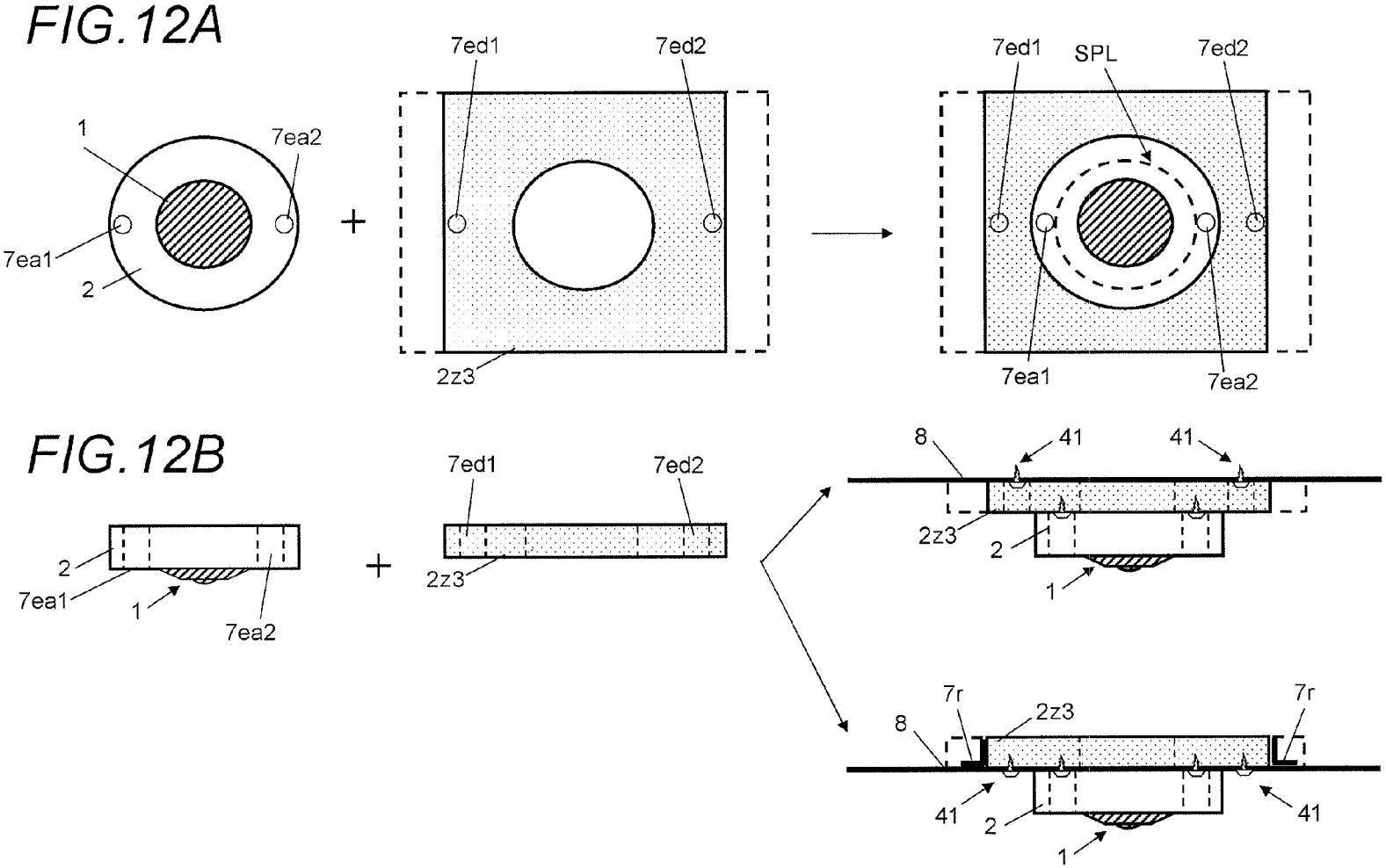
FIG. 12A is a front view illustrating a third example (a square coupling or a rectangular coupling) of coupling the expansion microphone unit onto the periphery of the omnidirectional microphone array device.
FIG. 12B is a side view illustrating the third example (a square coupling or a rectangular coupling) of coupling the expansion microphone unit onto the periphery of the omnidirectional microphone array device.

FIG. 12A is a front view illustrating a third example (a square coupling or a rectangular coupling) of coupling the expansion microphone unit 2*z*3 onto the periphery of the omnidirectional microphone array device 2 and FIG. 12B is a side view illustrating the third example (a square coupling or a rectangular coupling) of coupling the expansion microphone unit 2*z*3 onto the periphery of the omnidirectional microphone array device 2.

In FIG. 12A, as the third example of the expansion microphone unit, the expansion microphone unit 2*z*3 which includes an opening to surround the periphery of the omnidirectional microphone array device 2 and a rectangular housing (for example, a square or rectangular housing) is shown. Specifically, the expansion microphone unit 2*z*3 and the omnidirectional microphone array device 2 are separately disposed in the height direction (vertical direction) as shown in FIG. 12B without being coupled to each other on the same plane.

The coupling method is performed by releasing the omnidirectional microphone array device 2 and the camera device 1 from the ceiling surface 8, attaching the expansion microphone unit 2*z*3 to the ceiling surface 8 to be fixed by a screw 41 through screw holes 7*ed*1 and 7*ed*2, attaching the omnidirectional microphone array device 2 separately from the expansion microphone unit 2*z*3 in the height direction, and fixing the omnidirectional microphone array device 2 and the expansion microphone unit 2*z*3 by the screw 41 through the screw holes 7*ed*1 and 7*ed*2. Further, the omnidirectional microphone array device 2 and the expansion microphone unit 2*z*3 may be attached to the ceiling surface 8 so as to be fixed thereto and may be fixed by the screw 41 through the screw holes 7*ed*1 and 7*ed*2 respectively.

Accordingly, by the coupling of the expansion microphone unit 2*z*3 shown in FIG. 12A, the directivity control system 10 of the present embodiment can further and equally improve the sound collection properties of the sound with respect to all directions when compared to the sound collection properties of the sound when the omnidirectional microphone array device 2 is used alone by uniformly arranging plural microphone elements on the periphery of the opening of the expansion microphone unit 2*z*3, and can flexibly dispose the expansion microphone unit 2*z*3. In addition, the directivity control system 10 can improve sound collection performance in the vertical direction because the omnidirectional microphone array device 2 and the expansion microphone unit 2*z*3 are disposed separately from each other in the height direction.

Figures 13A, 13B:
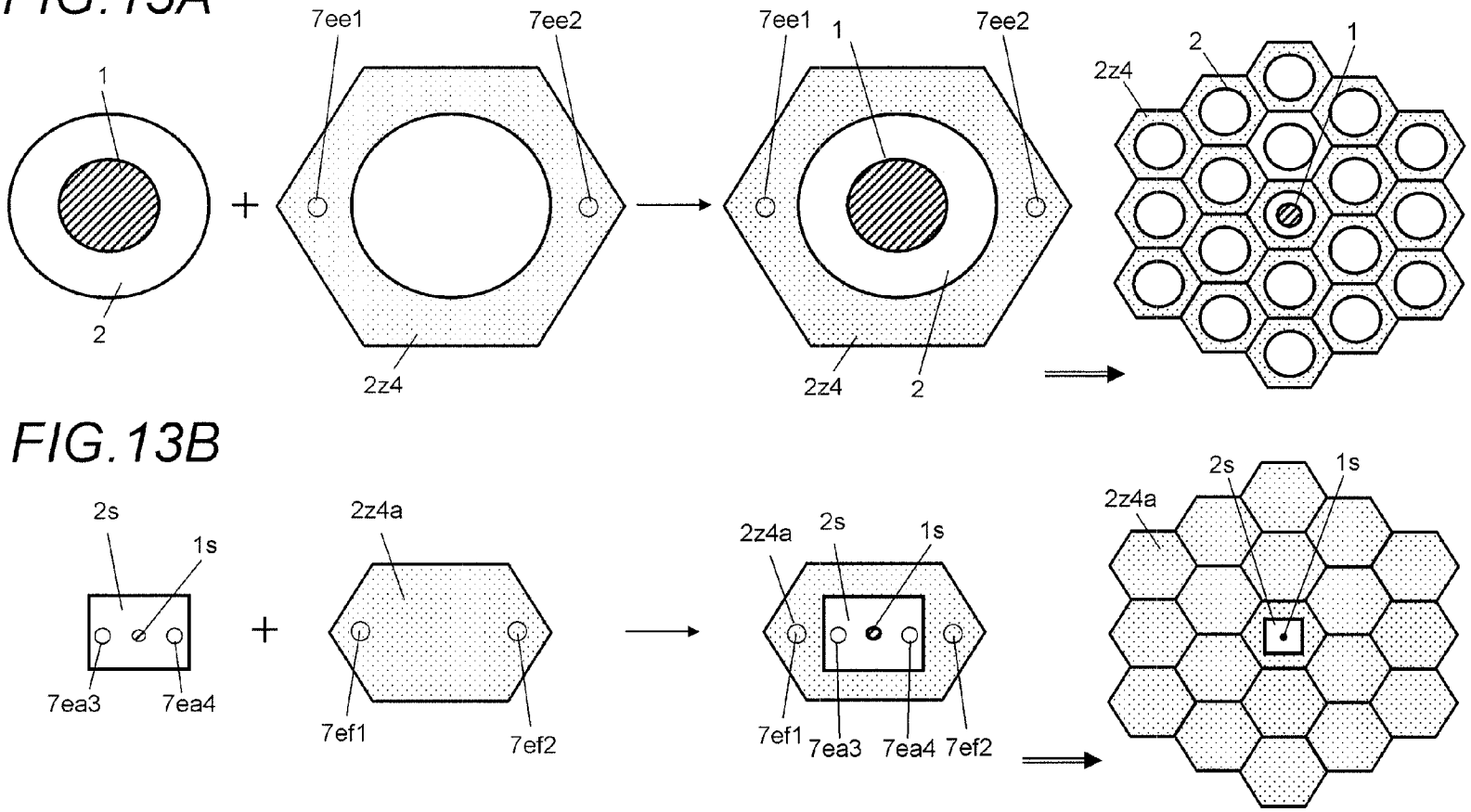
FIG. 13A is a front view illustrating a fourth example (a honeycomb type coupling) of coupling the expansion microphone unit onto the periphery of the omnidirectional microphone array device.
FIG. 13B is a front view illustrating a fifth example (a honeycomb type coupling) of coupling the expansion microphone unit onto the periphery of the omnidirectional microphone array device.

FIG. 13A is a front view illustrating a fourth example (a honeycomb type coupling) of coupling the expansion microphone unit 2*z*4 onto the periphery of the omnidirectional microphone array device 2. FIG. 13B is a front view illustrating a fifth example (a honeycomb type coupling) of coupling the expansion microphone unit 2*z*4 onto the periphery of the omnidirectional microphone array device 2*s*.

In FIG. 13A, as the fourth example of the expansion microphone unit, the expansion microphone unit 2*z*4 which includes an opening to surround the periphery of the omnidirectional microphone array device 2 and the honeycomb-shaped housing is shown. The attaching method of the expansion microphone unit 2*z*4 includes fixing by the screw 41 through screw holes 7*ee*1 and 7*ee*2 and other description is the same as that of the attaching method of the expansion microphone unit 2*z*1 shown in FIG. 10B, so the description thereof will not be repeated. The number of honeycomb-shaped expansion microphone units 2*z*4 to be attached is not limited to one, and may be two or more as needed.

In addition, in FIG. 13B, as the fifth example of the expansion microphone unit, the expansion microphone unit 2*z*4*a* including the honeycomb-shaped housing which is the same shape as that of the housing shown in FIG. 13A, and the shape of the housing of the omnidirectional microphone array device 2*s* is rectangular which is different from that of the housing of the omnidirectional microphone array device 2. The opening of the expansion microphone unit 2*z*4 shown in FIG. 13A is not formed in the expansion microphone unit 2*z*4*a*. Further, a fisheye camera (camera device) is using a fisheye lens is attached to the center of the omnidirectional microphone array device 2*s*. The attaching method of the expansion microphone unit 2*z*4*a* includes fixing by the screw 41 through screw holes 7*ef*1 and 7*ef*2 and the omnidirectional microphone array device 2*s* is fixed by the screw 41 through screw holes 7*ea*3 and 7*ea*4. Other description is the same as that of the attaching method of the expansion microphone unit 2*z*1 shown in FIG. 10B, so the description thereof will not be repeated.

Accordingly, the directivity control system 10 of the present embodiment can further uniformly improve the sound collection properties of the sound with respect to all directions when compared to the sound collection properties of the sound when the omnidirectional microphone array device 2 is used alone, and can flexibly dispose the expansion microphone units 2*z*4 and 2*z*4*a*, and then can make a difference between sound collection properties according to the expansion direction of the expansion microphone units 2*z*4 and 2*z*4*a* by coupling of the expansion microphone units 2*z*4 and 2*z*4*a* shown in FIGS. 13A and 13B by uniformly arranging plural microphone elements along the opening of the expansion microphone unit 2*z*4 or the outline of the expansion microphone unit 2*z*4*a*. Further, since the omnidirectional microphone array device 2 and the expansion microphone units 2*z*4 and 2*z*4*a* are disposed separately from each other in the height direction, the directivity control system 10 can improve the sound collection performance in the vertical direction (perpendicular direction).

Figure 14A:
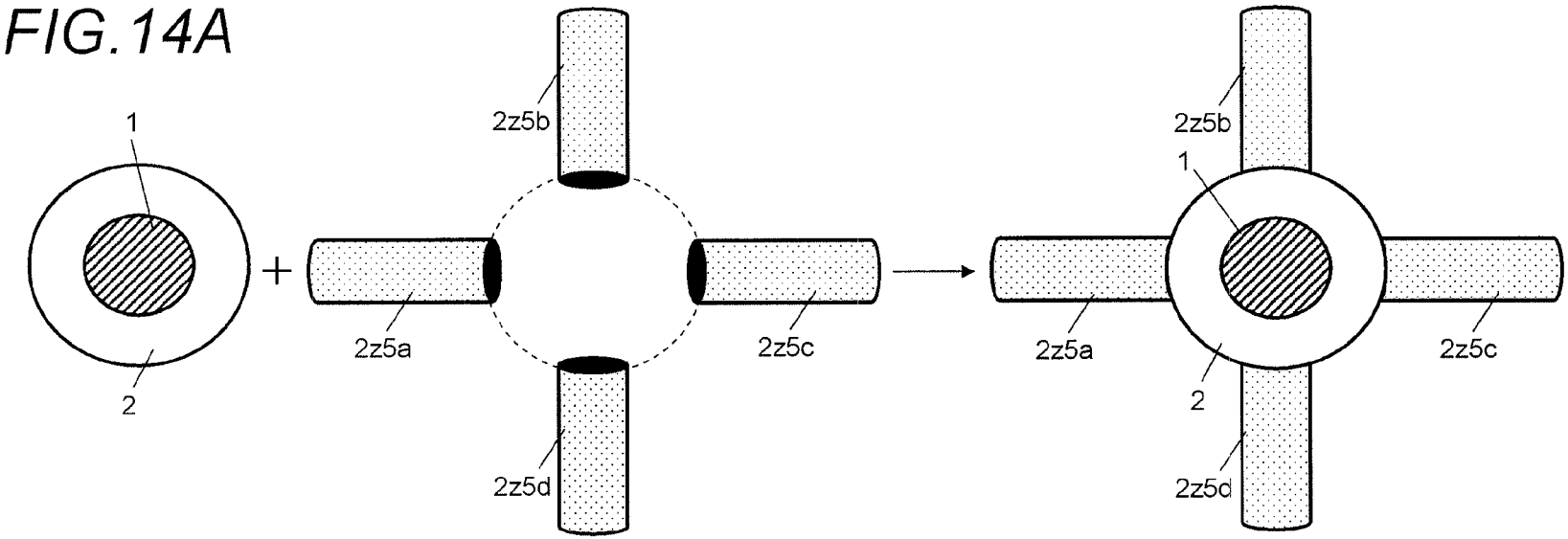
FIG. 14A is a front view illustrating a sixth example (a bar type coupling) of coupling the expansion microphone unit onto the periphery of the omnidirectional microphone array device.
Figure 14B:
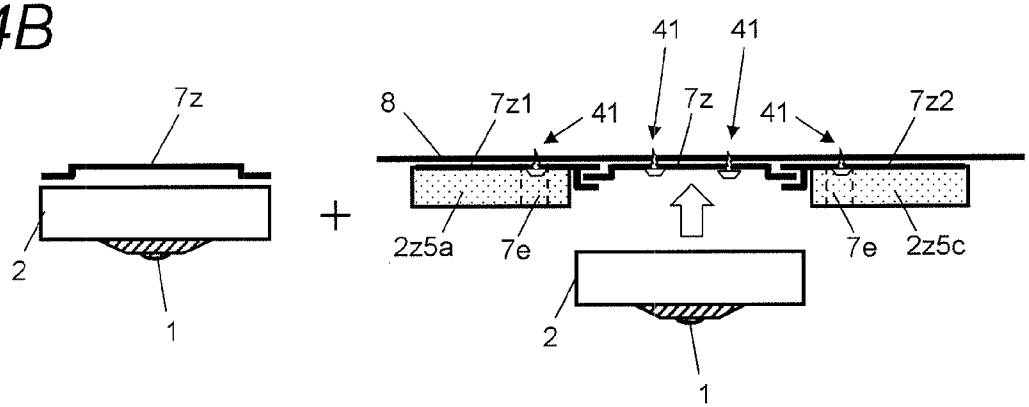
FIG. 14B is a side view illustrating the sixth example (a bar type coupling) of coupling the expansion microphone unit onto the periphery of the omnidirectional microphone array device.

FIG. 14A is a front view illustrating a sixth example (a bar type coupling) of coupling the expansion microphone units 2*z*5*a*, 2*z*5*b*, 2*z*5*c*, and 2*z*5*d* onto the periphery of the omnidirectional microphone array device 2. FIG. 14B is a side view illustrating the sixth example (a bar type coupling) of coupling the expansion microphone units 2*z*5*a*, 2*z*5*b*, 2*z*5*c*, and 2*z*5*d* onto the periphery of the omnidirectional microphone array device 2.

In FIG. 14A, as the sixth example of the expansion microphone unit, the expansion microphone units 2*z*5*a*, 2*z*5*b*, 2*z*5*c*, and 2*z*5*d* which include a long bar-shaped housing in a direction in the periphery of the omnidirectional microphone array device 2 are shown. Specifically, the expansion microphone units 2*z*5*a*, 2*z*5*b*, 2*z*5*c*, and 2*z*5*d* and the omnidirectional microphone array device 2 may be coupled with each other on the same plane or disposed separately from each other in the height direction (vertical direction).

The coupling method is performed by releasing the omnidirectional microphone array device 2 from the ceiling surface 8, fitting an end of the ceiling-mounted metal plate 7*z*, which is already provided, and end of attaching metal plates 7*z*1 and 7*z*2 for expansion for attaching the expansion microphone unit (for example, the expansion microphone units 2*z*5*a* and 2*z*5*c* to be engaged with each other, and fixing the ends with the screw 41. Further, the omnidirectional microphone array device 2 and the camera device 1 are fixed by the screw 41 attached to the ceiling-mounted metal plate 7*z*, and then the expansion microphone unit (for example, the expansion microphone units 2*z*5*a* and 2*z*5*c*) is attached to attaching metal plates 7*z*1 and 7*z*2 for expansion to be fixed by the screw 41.

Accordingly, by the coupling of the expansion microphone units 2*z*5*a*, 2*z*5*b*, 2*z*5*c*, and 2*z*5*d* shown in FIG. 14A, the directivity control system 10 of the present embodiment can further improve the sound collection properties of the sound with respect to the bar-shaped longitudinal direction when compared to the sound collection properties of the sound when the omnidirectional microphone array device 2 is used alone by uniformly arranging plural microphone elements along with the longitudinal direction of the expansion microphone units 2z5a, 2z5b, 2z5c, and 2z5d.

Figure 15B:
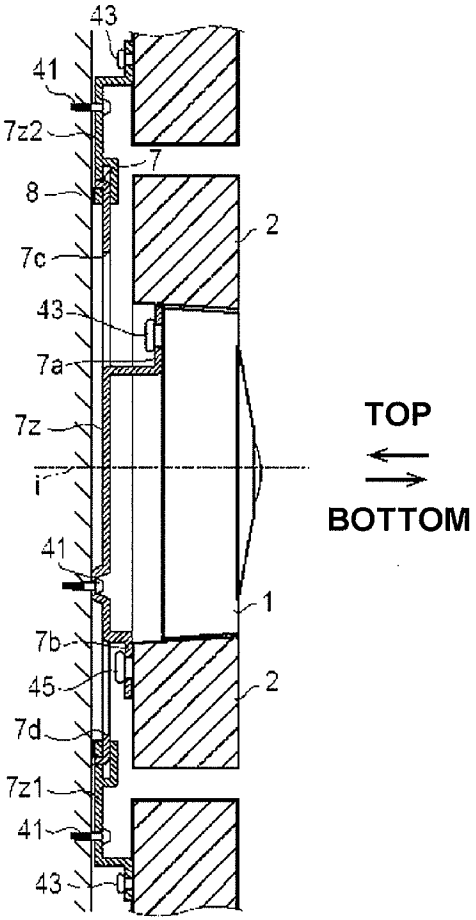
FIG. 15B is a side view illustrating a cross-section taken along line E-E of FIG. 15A and illustrating a state in which the expansion microphone unit is attached to the periphery of the omnidirectional microphone array device shown in FIG. 14B.
Figure 15A:
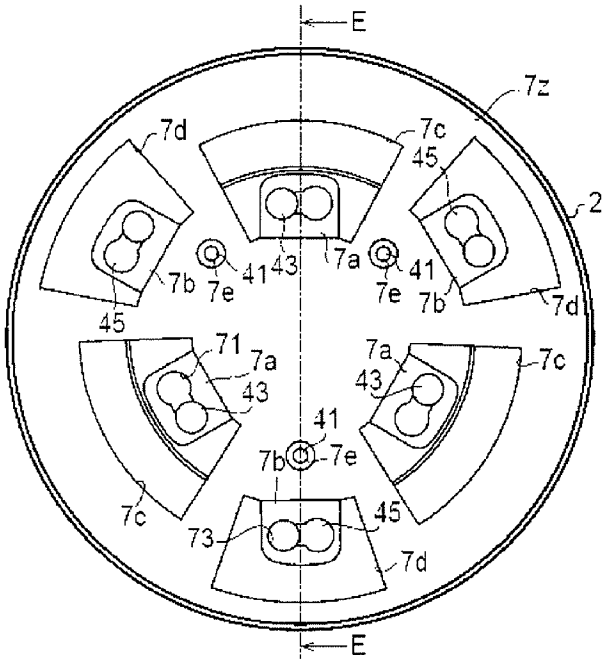
FIG. 15A is a plan view illustrating a state in which the omnidirectional microphone array device shown in FIG. 14B is attached to a ceiling-mounted metal plate.

Here, an attaching structure of the omnidirectional microphone array device 2 and the camera device 1 with respect to the ceiling-mounted metal plate 7z shown in FIG. 14B, an attaching structure of the expansion microphone units 2z5a and 2z5c with respect to the attaching metal plates 7z1 and 7z2 for expansion, and an engagement structure of the ceiling-mounted metal plate 7z and the attaching metal plates 7z1 and 7z2 for expansion will be described with reference to FIGS. 15A and 15B. FIG. 15A is a plan view illustrating a state in which the omnidirectional microphone array device 2 shown in FIG. 14B is attached to the ceiling-mounted metal plate 7z. FIG. 15B is a side view illustrating a cross-section taken along line E-E of FIG. 15A and illustrating a state in which the expansion microphone units 2z5a and 2z5c are attached to the periphery of the omnidirectional microphone array device 2 shown in FIG. 14B.

In FIG. 15A, an attaching structure of the omnidirectional microphone array device 2 and the camera device 1 when seen from the surface of the ceiling-mounted metal plate 7z, that is, when seen in the downward direction shown in FIG. 15B from the ceiling surface 8, is shown. The ceiling-mounted metal plate 7z is a metal member formed in an approximately disc-like shape having unevenness on the surface, but a member formed of ceramic or a synthetic resin (for example, plastic or elastomer) may be substituted for the member.

An engaging piece 7a, which projects to the same axis i direction, for attaching the camera device 1 to be fixed is formed in three sites on the concentric circle of the surface of the ceiling-mounted metal plate 7z toward the ceiling surface 8. Further, an engaging piece 7b, which projects to the same axis i direction, for attaching the omnidirectional microphone array device 2 to be fixed is formed in three sites on the concentric circle, the diameter of which is larger than that of the concentric circle on which the engaging piece 7a is formed, of the surface of the ceiling-mounted metal plate 7z.

An engaging hole 71 engaged with a fixing pin 43 which is provided on the bottom of the camera device 1 is formed on the engaging piece 7a in a gourd shape whose diameter of one end portion is larger than that of the other end portion. In the same manner, an engaging hole 73 engaged with a fixing pin 45 which is provided on the bottom of the omnidirectional microphone array device 2 is formed on the engaging piece 7b in a gourd shape whose diameter of one end portion is larger than that of the other end portion.

The fixing pins 43 and 45 respectively include a head portion having a thickness (diameter) from one end portion to the other end portion of the engaging holes 71 and 73 respectively and a body portion which is thinner than the head portion.

Fan-shaped holes 7c and 7d are formed in three sites respectively on the surface of the ceiling-mounted metal plate 7z such that the holes expand outward of the engaging pieces 7a and 7b. The shapes and the positions of these fan-shaped holes 7c and 7d are designed such that the reference directions of each horizontal angle of the omnidirectional microphone array device 2 and the camera device 1 are matched to each other in a case where the omnidirectional microphone array device 2 and the camera device 1 are attached to the ceiling-mounted metal plate 7z.

Screw holes 7e to which the screws 41 are inserted are formed in three sites on the central portion of the surface of the ceiling-mounted metal plate 7z. The ceiling-mounted metal plate 7z is fixed to the ceiling surface 8 by screwing the screw 41 to the ceiling surface 8 via the screw hole 7e.

When the omnidirectional microphone array device 2 and the camera device 1 are attached to the ceiling-mounted metal plate 7z, the camera device 1 is firstly attached to the ceiling-mounted metal plate 7z. In this case, the fixing pin 43 is engaged with the engaging hole 71 formed in the engaging piece 7a.

That is, the fixing pin 43 which projects to the bottom of the camera device 1 is inserted into one end portion side whose diameter of the engaging hole 71 is large. Further, in a state in which the head portion of the fixing pin 43 is projected from the engaging hole 71, the fixing pin 43 is allowed to be moved in the engaging hole 71 by allowing the camera device 1 to rotate clockwise or counterclockwise (rotary engaging system). Further, in a state in which the head portion of the fixing pin 43 is moved to another end side of the engaging hole 71, the fixing pin 43 and the engaging hole 71 are engaged with each other, and the camera device 1 is fixed in the same axis i direction.

The omnidirectional microphone array device 2 is attached to the ceiling-mounted metal plate 7z such that the camera device 1 is exposed from the inside of the opening 21a of the omnidirectional microphone array device 2 after the camera device 1 is attached to the ceiling-mounted metal plate 7z. In this case, the fixing pin 45 is engaged with the engaging hole 73 formed on the engaging piece 7b. Further, the procedures of fixing the fixing pin 45 to the engaging hole 73 are the same as the procedures of fixing the fixing pin 43 to the engaging hole 71.

Figure 16B:
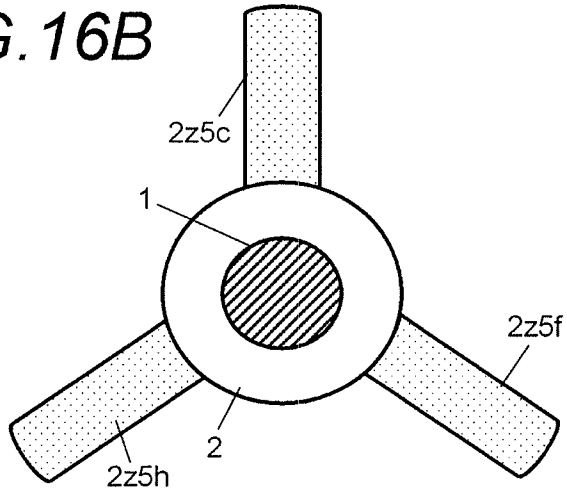
FIG. 16B is a front view illustrating an eighth example (a bar type coupling) of coupling the expansion microphone unit onto the periphery of the omnidirectional microphone array device.
Figure 16C:
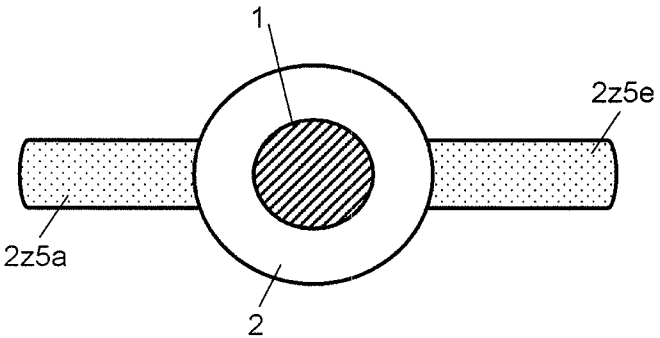
FIG. 16C is a front view illustrating a ninth example (a bar type coupling) of coupling the expansion microphone unit onto the periphery of the omnidirectional microphone array device.
Figure 16A:
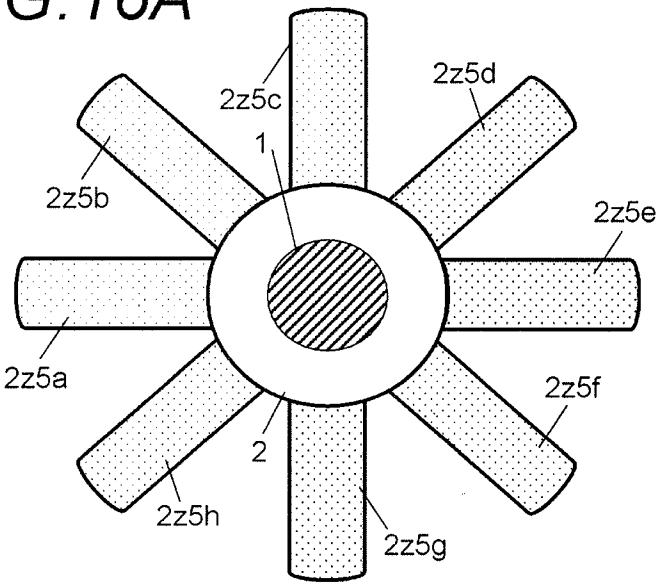
FIG. 16A is a front view illustrating a seventh example (a bar type coupling) of coupling the expansion microphone unit onto the periphery of the omnidirectional microphone array device.

FIG. 16A is a front view illustrating the seventh example (a bar type coupling) of coupling the expansion microphone units 2z5a, 2z5b, 2z5c, 2z5d, 2z5e, 2z5f, 2z5g, and 2z5h onto the periphery of the omnidirectional microphone array device 2. FIG. 16B is a front view illustrating the eighth example (a bar type coupling) of coupling the expansion microphone units 2z5c, 2z5f, and 2z5h onto the periphery of the omnidirectional microphone array device 2. FIG. 16C is a front view illustrating the ninth example (a bar type coupling) of coupling the expansion microphone units 2z5a and 2z5e onto the periphery of the omnidirectional microphone array device 2.

In FIGS. 16A to 16C, since the effects of the attaching method of respective expansion microphone units and of attaching the expansion microphone units are also the same as the effects of the attaching method of the expansion microphone units 2z5a, 2z5b, 2z5c, and 2z5d and of attaching the expansion microphone units except the number of the expansion microphone units, the description thereof will not be repeated.

Figure 17A:
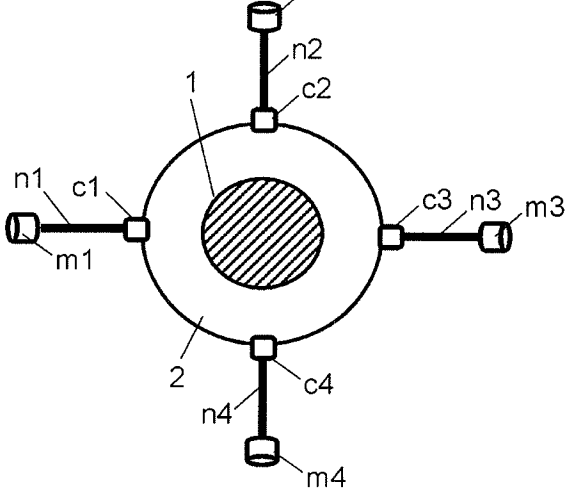
FIG. 17A is a front view illustrating a tenth example (a skeleton type coupling) of coupling the expansion microphone unit onto the periphery of the omnidirectional microphone array device.
Figure 17B:
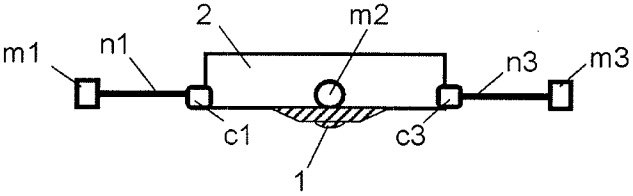
FIG. 17B is a side view illustrating the tenth example (a skeleton type coupling) of coupling the expansion microphone unit onto the periphery of the omnidirectional microphone array device.
Figure 17C:
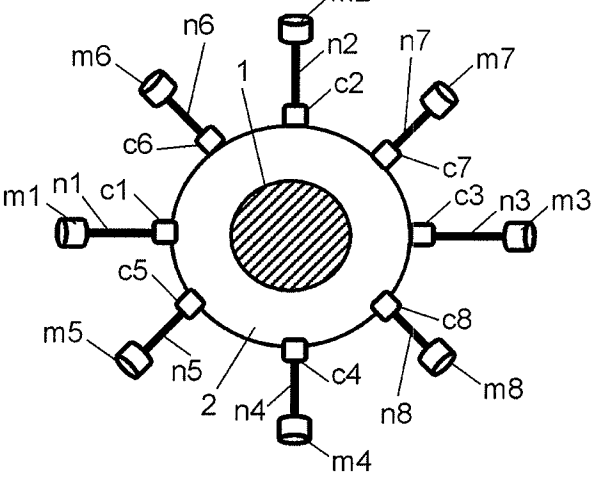
FIG. 17C is a front view illustrating an eleventh example (a skeleton type coupling) of coupling the expansion microphone unit onto the periphery of the omnidirectional microphone array device.
Figure 17D:
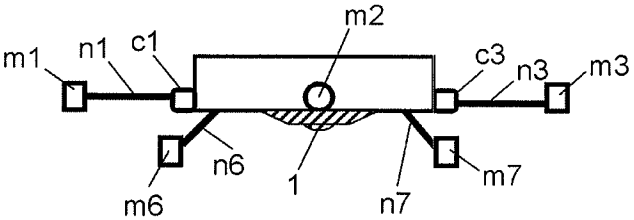
FIG. 17D is a side view illustrating the eleventh example (a skeleton type coupling) of coupling the expansion microphone unit onto the periphery of the omnidirectional microphone array device.

FIG. 17A is a front view illustrating the tenth example (a skeleton type coupling) of coupling the expansion microphone units m1, m2, m3, and m4 onto the periphery of the omnidirectional microphone array device 2. FIG. 17B is a side view illustrating the tenth example (a skeleton type coupling) of coupling the expansion microphone units m1, m2, m3, and m4 onto the periphery of the omnidirectional microphone array device 2. FIG. 17C is a front view illustrating the eleventh example (a skeleton type coupling) of coupling the expansion microphone units m1, m2, m3, m4, m5, m6, m7, and m8 onto the periphery of the omnidirectional microphone array device 2. FIG. 17D is a side view illustrating the eleventh example (a skeleton type coupling) of coupling the expansion microphone units m1, m2, m3, m4, m5, m6, m7, and m8 onto the periphery of the omnidirectional microphone array device 2.

In FIG. 17A, as the tenth example of the expansion microphone unit, the expansion microphone units m1, m2, m3, and m4 are coupled to connectors c1, c2, c3, and c4 provided in four sites toward the housing of the omnidirectional microphone array device 2 via microphone line accommodating tubes n1, n2, n3, and n4.

Firstly, the coupling method is performed by connecting the microphone line accommodating tubes n1, n2, n3, and n4 to the connectors c1, c2, c3, and c4 provided in four sites facing the housing of the omnidirectional microphone array device 2. The microphone line accommodating tubes n1, n2, n3, and n4 are produced by, for example, a resin mold, and a signal line for transmitting sound data of the sound collected by the omnidirectional microphone units m1, m2, m3, and m4 are accommodated therein. After the microphone line accommodating tubes n1, n2, n3, and n4 are connected to the connectors c1, c2, c3, and c4, the expansion microphone units m1, m2, m3, and m4 are connected to the microphone line accommodating tubes n1, n2, n3, and n4, and the coupling of the expansion microphone units m1, m2, m3, and m4 are ended.

Accordingly, by coupling the expansion microphone units m1, m2, m3, and m4 shown in FIG. 17A, since the directivity control system 10 of the present embodiment does not need a housing for accommodating a microphone element in the above-described expansion microphone unit and can collect the sound by removing the resonance of the sound (sound wave) due to the housing, it is not necessary to dispose the omnidirectional microphone array device 2 and the expansion microphone units m1, m2, m3, and m4 separately from each other in the height direction. In addition, the directivity control system 10 can easily connect the connectors c1, c2, c3, and c4 provided on the periphery of the omnidirectional microphone array device 2 to the expansion microphone units m1, m2, m3, and m4 via microphone line accommodating tubes n1, n2, n3, and n4 via the microphone line accommodating tubes n1, n2, n3, and n4, and can reduce the weight of the expansion microphone unit when compared to the case expanding the expansion microphone unit including a housing with a predetermined shape in the omnidirectional microphone array device 2, and can further improve the sound collection properties in the microphone element in the expansion microphone unit.

In FIG. 17C, since the attaching method of respective expansion microphone units is the same as the attaching method of the expansion microphone units m1, m2, m3, and m4 in FIG. 17A except the number of the expansion microphone units, the description thereof will not be repeated. As to the advantage, since the expansion microphone units m5, m6, m7 and m8 which are different in height from the expansion microphone units m1, m2, m3 and m4 are added, the sound collecting performance is improved in the vertical direction in comparison with the tenth example in which only the expansion microphone units m1, m2, m3, and m4 are connected.

Figure 18A:
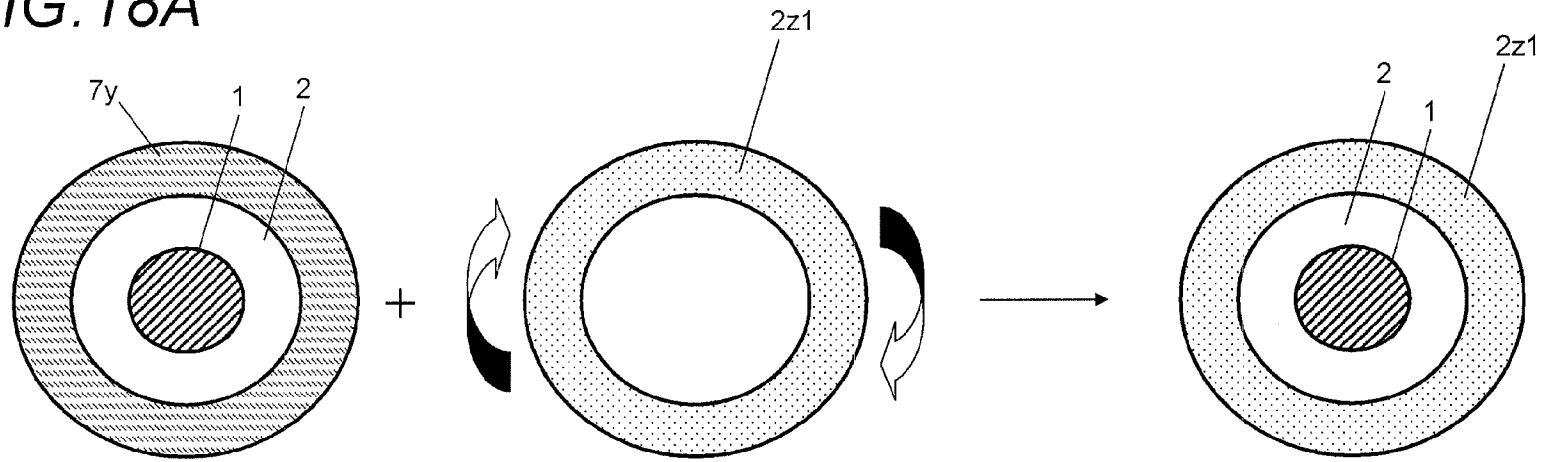
FIG. 18A is a front view illustrating a first example of the coupling method of the expansion microphone unit onto the periphery of the omnidirectional microphone array device.
Figure 18B:
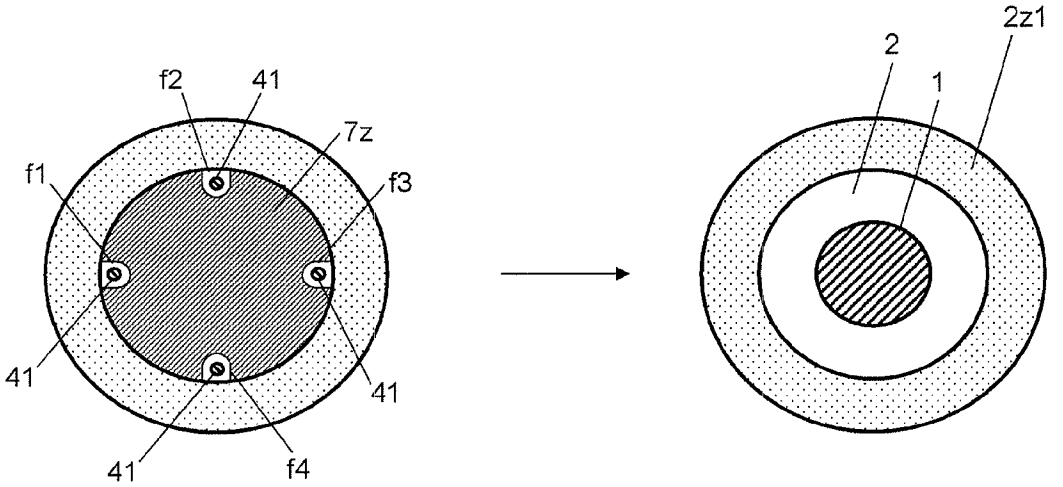
FIG. 18B is a front view illustrating a second example of the coupling method of the expansion microphone unit onto the periphery of the omnidirectional microphone array device.

FIG. 18A is a front view illustrating the first example of the coupling method of the expansion microphone unit 2z which includes an opening to surround the periphery of the omnidirectional microphone array device 2 and includes a housing (doughnut-like housing) arranged concentrically with the omnidirectional microphone array device 2. FIG. 18B is a front view illustrating the second example of the coupling method of the expansion microphone unit 2z1 onto the periphery of the omnidirectional microphone array device 2.

In the coupling method shown in FIG. 18A, the omnidirectional microphone array device 2 and the camera device 1 are connected to an enlarged ceiling-mounted metal plate 7y in advance, and the expansion microphone unit 2z1 is connected to the enlarged ceiling-mounted metal plate 7y so as to surround the periphery of the omnidirectional microphone array device 2 when the expansion microphone unit 2z1 is coupled.

The coupling method shown in FIG. 18B is performed by releasing the omnidirectional microphone array device 2 and the camera device 1 from the existing ceiling-mounted metal plate 7z, fixing four fixing units f1, f2, f3, and f4 on the ceiling-mounted metal plate 7z, and allowing four fixing units f1, f2, f3, and f4 to respectively contain the screws 41 in a case where the expansion microphone unit 2z1 is coupled to the ceiling-mounted metal plate 7z. Then, the omnidirectional microphone array device 2 and the camera device 1 are attached so as to be accommodated in the opening of the expansion microphone unit 2z1.

Figures 19A, 19B, 19C:
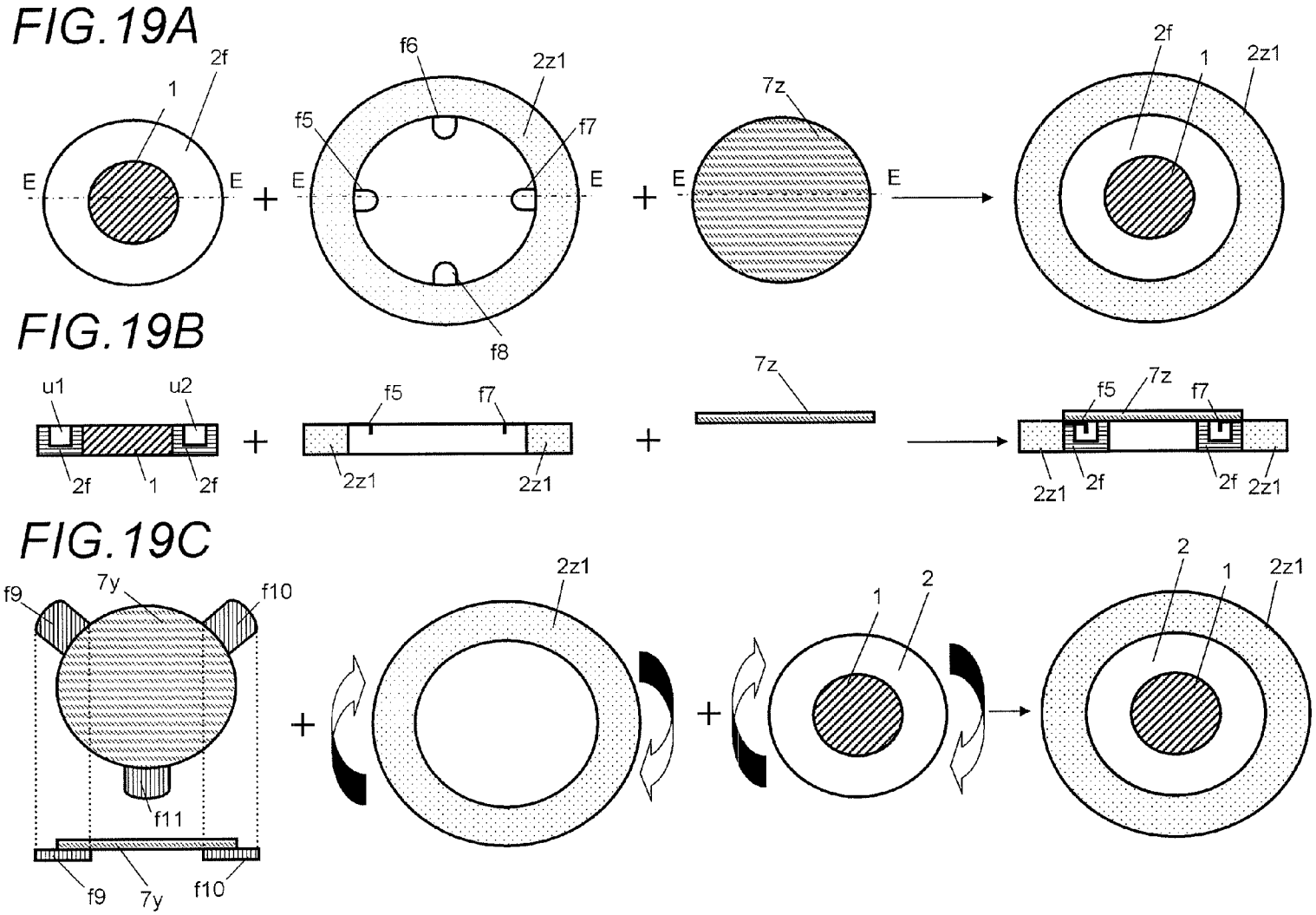
FIG. 19A is a front view illustrating a third example of the coupling method of the expansion microphone unit onto the periphery of the omnidirectional microphone array device.
FIG. 19B is a side view illustrating a cross-section taken along line E-E of FIG. 19A and illustrating the third example of the coupling method of the expansion microphone unit onto the periphery of the omnidirectional microphone array device.
FIG. 19C is a supplementary explanatory view illustrating a fourth example of the coupling method of the expansion microphone unit onto the periphery of the omnidirectional microphone array device.

FIG. 19A is a front view illustrating the third example of the coupling method of the expansion microphone unit 2z1 onto the periphery of the omnidirectional microphone array device 2f, FIG. 19B is a side view illustrating a cross-section taken along line E-E of FIG. 19A, and illustrating the third example of the coupling method of the expansion microphone unit 2z1 onto the periphery of the omnidirectional microphone array device 2f, and FIG. 19C is a supplementary explanatory view illustrating the fourth example of the coupling method of the expansion microphone unit 2z1 onto the periphery of the omnidirectional microphone array device 2. In the examples shown in FIGS. 19A and 19B, concave portions u1 and u2 with which two hook portions f5 and f7 can be engaged on the inner circumference of the housing of the omnidirectional microphone array device 2f.

The coupling method shown in FIGS. 19A and 19B is performed by releasing the omnidirectional microphone array device 2f and the camera device 1 from the existing ceiling-mounted metal plate 7z, engaging hook portions f5, f6, f7, and f8 provided in four sites facing the opening of the expansion microphone unit 2z1 with the concave portions u1 and u2, to be fixed on the ceiling-mounted metal plate 7z, and allowing four hooks portions f5, f6, f7, and f8 to attach the omnidirectional microphone array device 2f and the camera device 1.

In the coupling method shown in FIG. 19C, the existing ceiling-mounted metal plate 7z is exchanged to, for example, the ceiling-mounted metal plate 7y with three hook portions f9, f10, and f11 provided therein. The expansion microphone unit 2z1 is coupled to the omnidirectional microphone array device 2 by connecting the expansion microphone unit 2z1, the omnidirectional microphone array device 2, and the camera device 1 to the ceiling-mounted metal plate 7y in order by the rotary engaging system (see FIG. 15A)

Figure 20:
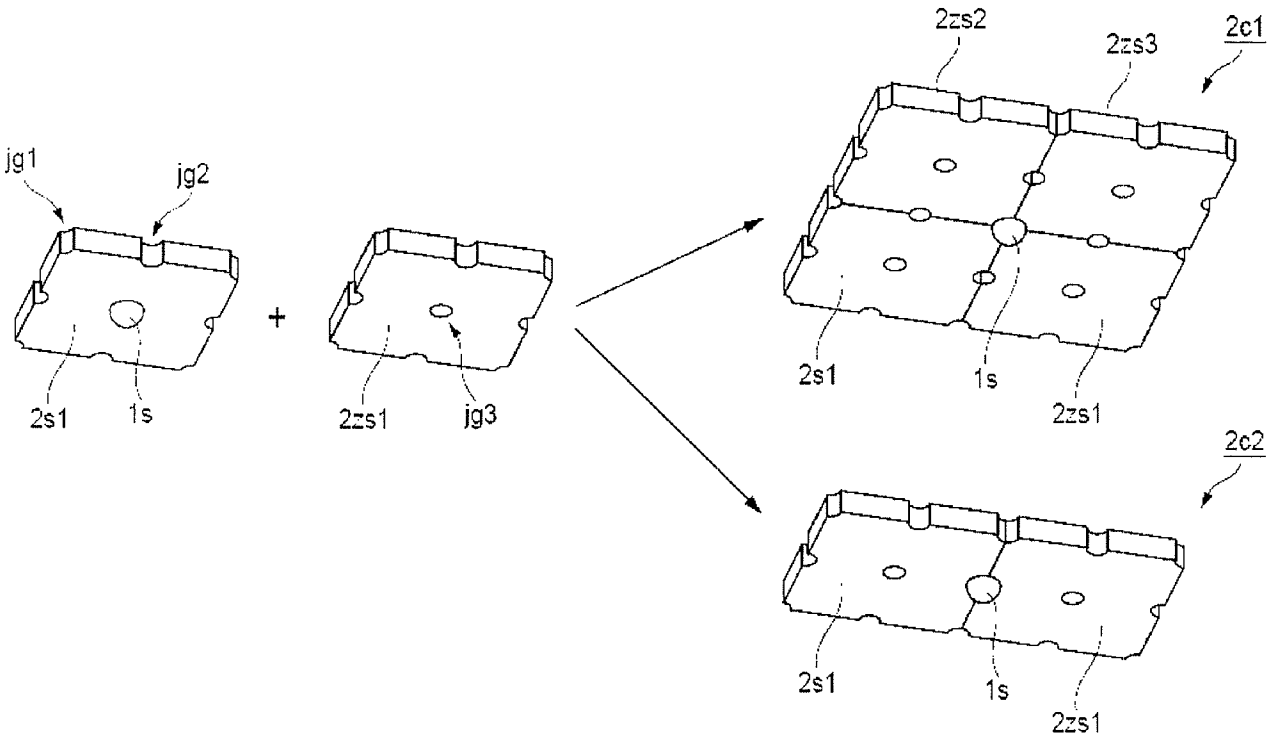
FIG. 20 is a perspective view illustrating a twelfth example (a piece type coupling) of coupling the expansion microphone unit onto the periphery of the omnidirectional microphone array device.

FIG. 20 is a perspective view illustrating the twelfth example (a piece type coupling) of coupling the expansion microphone unit 2zs1 onto the periphery of the omnidirectional microphone array device 2s1. The housing of the omnidirectional microphone array device 2s1 is rectangular and is provided with a circular connecting unit jg3 in the center thereof, which can accommodate a fisheye camera 1s containing a fisheye lens or a cover having the same size as the fisheye camera 1s in the center thereof; a connecting unit jg2 for connecting intermediate sides, on which a semicircular concave surface is formed, is provided on the intermediate side portion thereof; and a connecting unit jg1 for connecting opposite ends, on which a quadrant concave surface is formed, on opposite end portions.

In the coupling method shown in FIG. 20, the expansion microphone unit 2*zs*1 is adjacent to the periphery of the housing of the omnidirectional microphone array device 2*s*1, and is coupled thereto by adhesion or the like so as to be flush with each other, and then fixed thereto. In the coupling method shown in FIG. 20, one or plural expansion microphone units 2*zs*1 can be coupled to the omnidirectional microphone array device 2*s*1, and the fisheye camera 1*s* is moved to the center of the housing after the omnidirectional microphone array device 2*s*1 is coupled to the expansion microphone unit.

Accordingly, by the coupling of the expansion microphone unit 2*zs*1 shown in FIG. 20, the directivity control system 10 of the present embodiment can easily connect the expansion microphone unit 2*zs*1 to the periphery of the omnidirectional microphone array device 2*s*1 and easily move the fisheye lens is disposed in the center of the housing of the omnidirectional microphone array device 2*s*1 to the center position having the shape of the housing of the omnidirectional microphone array device 2*s*1 and the expansion microphone unit 2*zs*1 after connection (after coupling) along with the shape of the housing of the omnidirectional microphone array device 2*s*1 and the expansion microphone unit 2*zs*1 after connection (after coupling) according to the number of connections of the expansion microphone unit 2*zs*1.

Figure 21:
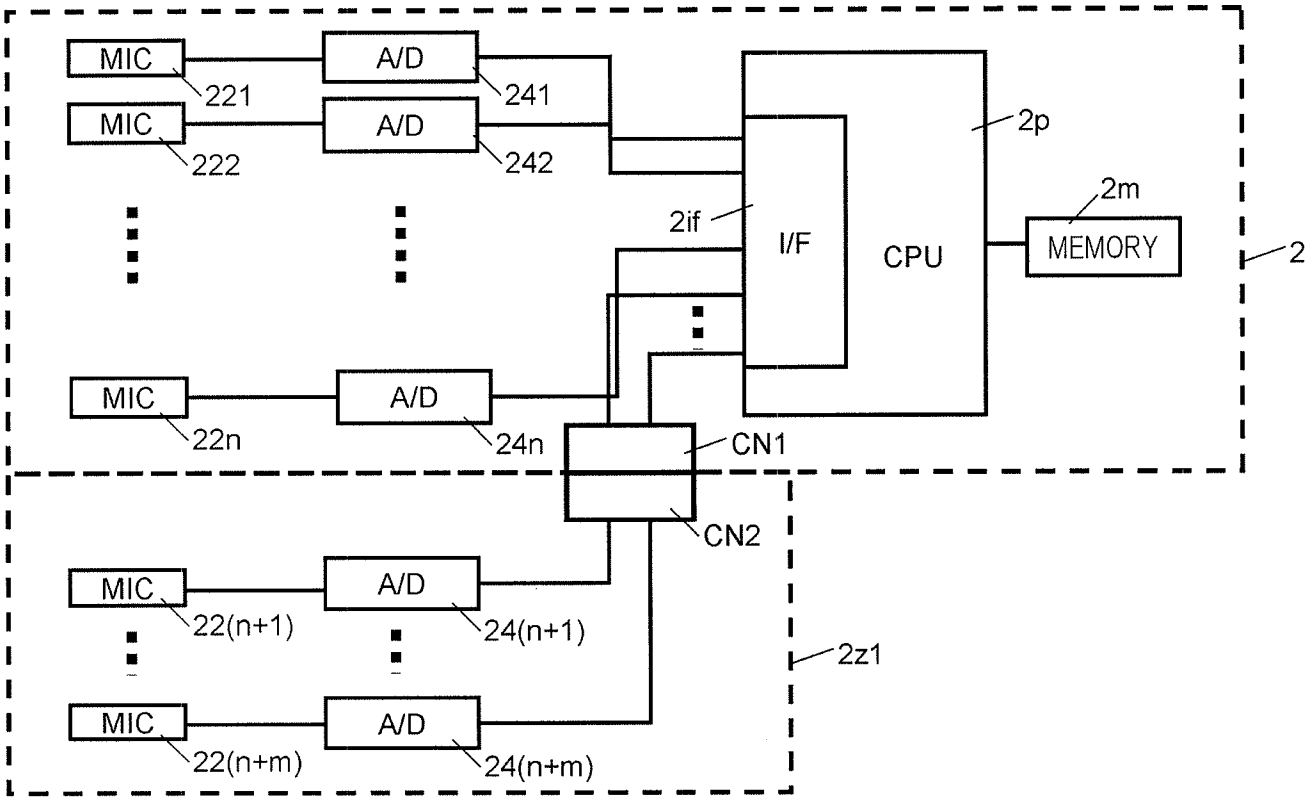
FIG. 21 is a block diagram illustrating an example of a hardware configuration of the omnidirectional microphone array device to which the expansion microphone unit is coupled.

Finally, a hardware configuration of the omnidirectional microphone array device 2 and the expansion microphone unit in a case where the expansion microphone unit of the present embodiment is coupled to the omnidirectional microphone array device 2 will be simply described with reference to FIG. 21. FIG. 21 is a block view illustrating an example of the hardware configuration of the omnidirectional microphone array device 2 to which the expansion microphone unit 2*z*1 is coupled. Further, a connecting line to the network NW shown in FIG. 1 is not illustrated in FIG. 21.

The expansion microphone unit 2*z*1 includes at least plural (for example, m) microphone elements 22(*n*+1) to 22(*n*+m) and ADCs 24(*n*+1) to 24(*n*+m) having the same number of the microphone elements. The expansion microphone unit 2*z*1 can be coupled to the omnidirectional microphone array device 2 via a coupling unit CN2. Analog sound signals collected by the microphone elements 22(*n*+1) to 22(*n*+m) of the expansion microphone unit 2*z*1 are converted to digital sound signals in the ADCs 24(*n*+1) to 24(*n*+m), and then input to an I/F unit 2*if* of the omnidirectional microphone array device 2. A CPU 2*p* transmits the sound signals collected by the microphone elements 221 to 22*n* in the omnidirectional microphone array device 2 and the expansion microphone units 22(*n*+1) to 22(*n*+m) to the directivity control apparatus 3 from a communication I/F unit (not illustrated).

Hereinafter, configurations, operations, and effects of the directivity control apparatus, the directivity control method, and the directivity control system according to aspects of the present invention will be described.

An aspect of the present invention provides a directivity control apparatus for controlling a directivity of a sound collected by a sound collecting unit including a plurality of microphones, the directivity control apparatus including: a beam forming unit, configured to form a beam in a direction from the sound collecting unit toward a sound source corresponding to a position designated in an image on a display unit; and a magnification setting unit, configured to set a magnification for magnifying or demagnifying the image in the display according to an input, wherein the beam forming unit is configured to change a size of the formed beam in accordance with the magnification set by the magnification setting unit.

The directivity control apparatus may be configured so that the beam forming unit is configured to decrease the size of the beam in a case where the magnification is set to magnify the image by the magnification setting unit.

The directivity control apparatus may be configured so that the beam forming unit is configured to increase the size of the beam in a case where the magnification is set to demagnify the image by the magnification setting unit.

The directivity control apparatus may be configured so that the beam forming unit is configured to determine whether to adjust a volume level of the sound according to the magnification set by the magnification setting unit.

The directivity control apparatus may be configured so that the beam forming unit is configured to increase the volume level of the sound in a case where the magnification is set to magnify the image by the magnification setting unit.

The directivity control apparatus may be configured so that the beam forming unit is configured to decrease the volume level of the sound in a case where the magnification is set to demagnify the image by the magnification setting unit.

The directivity control apparatus may be configured by further including an image processing unit, configured to process the image displayed on the display unit, wherein the beam forming unit is configured to maintain the size of the beam in a case where a person is undetected in the image by the image processing unit.

The directivity control apparatus may be configured so that the beam forming unit is configured to perform a voice change processing on the sound in a case where the magnification is set to magnify the image by the magnification setting unit.

The directivity control apparatus may be configured so that the image processing unit is configured to perform a masking processing on a part of the person in the image in a case where the magnification is set to magnify the image by the magnification setting unit.

An aspect of the present invention provides a directivity control method in a directivity control apparatus for controlling a directivity of a sound collected by a sound collecting unit including a plurality of microphones, the directivity control method including; forming a beam in a direction from the sound collecting unit toward a sound source corresponding to a position designated in an image on a display unit; setting a magnification for magnifying or demagnifying the image in the display according to an input; and changing a size of the formed beam in accordance with the magnification as set.

An aspect of the present invention provides a non-transitory storage medium, in which a program is stored, the program causing a directivity control apparatus for controlling a directivity of a sound collected by a sound collecting unit including a plurality of microphones to execute the following steps of: forming a beam in a direction from the sound collecting unit toward a sound source corresponding to a position designated in an image on a display unit; setting a magnification for magnifying or demagnifying the image in the display according to an input; and changing a size of the formed beam in accordance with the magnification as set.

An aspect of the present invention provides a directivity control system, including: an imaging unit, configured to capture an image in a sound collection area; a first sound collecting unit including a plurality of microphones, configured to collect sound in the sound collection area; and a directivity control apparatus, configured to control a directivity of the sound collected by the first sound collecting unit, wherein the directivity control apparatus includes: a display unit on which image in the sound collection area captured by the imaging unit is displayed; a beam forming unit, configured to form a beam in a direction from the first sound collecting unit toward a sound source corresponding to a position designated in an image on a display unit; and a magnification setting unit, configured to set a magnification for magnifying or demagnifying the image in the display according to an input, wherein the beam forming unit is configured to change a size of the formed beam in accordance with the magnification set by the magnification setting unit.

The directivity control system may be configured by further including a second sound collecting unit which includes an opening surrounding a periphery of the first sound collecting unit, and a housing arranged concentrically with the first sound collecting unit.

The directivity control system may be configured by further including a second sound collecting unit which includes an opening surrounding a periphery of the first sound collecting unit, and an elliptic housing.

The directivity control system may be configured by further including a second sound collecting unit which includes an opening surrounding a periphery of the first sound collecting unit, and a rectangular housing.

The directivity control system may be configured by further including a second sound collecting unit which includes an opening surrounding a periphery of the first sound collecting unit, and a honeycomb-shaped housing.

The directivity control system may be configured so that the first sound collecting unit and the second sound collecting unit are disposed by being separated from each other in a height direction of the first sound collecting unit and the second sound collecting unit.

The directivity control system may be configured by further including a second sound collecting unit including at least one bar-shaped housing in a periphery of the first sound collecting unit.

The directivity control system may be configured by further including at least one second sound collecting unit disposed in a periphery of the first sound collecting unit, wherein the second sound collecting unit is connected to a connector provided in a periphery of the first sound collecting unit via a predetermined signal line accommodating tube.

The directivity control system may be configured by further including a second sound collecting unit including a rectangular housing which is the same as that of the first sound collecting unit, wherein each of the housings of the first sound collecting unit and the second sound collecting unit has an intermediate side portion provided with a connecting unit for connecting intermediate sides along which a semicircular concave surface is formed and opposite end portions provided with a connecting unit for connecting opposite ends at with a quadrant concave surface is formed.

An aspect of the present invention provides a directivity control system, including: an imaging unit, configured to capture an image in a sound collection area; a first sound collecting unit including a plurality of microphones, configured to collect sound in the sound collection area; a second sound collecting unit disposed in a periphery of the first sound collecting unit; and a directivity control apparatus, configured to control a directivity of the sound collected by the first sound collecting unit and the second collecting unit, wherein the directivity control apparatus includes: a display unit on which image in the sound collection area captured by the imaging unit is displayed; and a beam forming unit, configured to form a beam in a direction from the first sound collecting unit toward a sound source corresponding to a position designated in an image on a display unit according to a designation of the position.

The directivity control system may be configured so that the second sound collecting unit includes an opening surrounding a periphery of the first sound collecting unit, and a housing arranged concentrically with the first sound collecting unit.

The directivity control system may be configured so that the second sound collecting unit includes an opening surrounding a periphery of the first sound collecting unit, and an elliptic housing.

The directivity control system may be configured so that the second sound collecting unit includes an opening surrounding a periphery of the first sound collecting unit, and a rectangular housing.

The directivity control system may be configured so that the second sound collecting unit includes an opening surrounding a periphery of the first sound collecting unit, and a honeycomb-shaped housing.

The directivity control system may be configured so that the first sound collecting unit and the second sound collecting unit are disposed by being separated from each other in a height direction of the first sound collecting unit and the second sound collecting unit.

The directivity control system may be configured so that the second sound collecting unit includes at least one bar-shaped housing in a periphery of the first sound collecting unit.

The directivity control system may be configured so that the second sound collecting unit is disposed in a periphery of the first sound collecting unit, wherein the second sound collecting unit is connected to a connector provided in a periphery of the first sound collecting unit via a predetermined signal line accommodating tube.

The directivity control system may be configured so that the second sound collecting unit includes a rectangular housing which is the same as that of the first sound collecting unit, and each of the housings of the first sound collecting unit and the second sound collecting unit has an intermediate side portion provided with a connecting unit for connecting intermediate sides along which a semicircular concave surface is formed and opposite end portions provided with a connecting unit for connecting opposite ends at with a quadrant concave surface is formed.

Hereinbefore, various embodiments have been described with reference to the accompanying drawings, but the present invention is not limited to the examples. It is obvious that various modifications or corrections can be made by those skilled in the art within the scope of the present invention and understood that those modifications and corrections belong to the technical range of the present invention.

In the above embodiments, a description is made as an example in which the width of the beam in the directivity direction is adjusted by use of information on the magnification in the zoom-in processing or the zoom-out processing. However, the adjustment of the beam is not limited to the width of the beam, but any types of the size of the beam may be adjusted. For example, the height of the beam (i.e., a width of the beam in a direction orthogonal to the directivity direction) may be adjusted in stead of the width of the beam in the directivity direction.

The present invention can be effectively used as a directivity control apparatus, a directivity control method and a directivity control system which appropriately form the directivity of a sound with respect to an object serving as a monitoring target as changed and suppress deterioration of the efficiency of a monitoring task performed by an observer even when the object of the monitoring target is changed by a zoom processing with respect to the monitoring target.

What is claimed is:

1. A directivity control apparatus for controlling a directivity of a sound collected by a sound collector, including a plurality of microphones, the directivity control apparatus comprising:

a memory that stores instructions; and a processor that, when executing the instructions stored in the memory, performs operations comprising:

displaying a first image on a display;

receiving a first user input designating a position within the first image;

generating, based on the first image, a second image having a center different from a center of the first image and corresponding to a partial area of the first image including the designated position, when the designated position by the first user input does not correspond to the center of the first image, and displaying the second image on the display;

forming a directivity of the sound collected by the sound collector, wherein a direction of the formed directivity is determined based on the center of the second image;

setting a magnification for magnifying or demagnifying the second image on the display according to a second user input to the second image on the display; and changing a size of a beam corresponding to the formed directivity in accordance with the set magnification.

2. The directivity control apparatus according to claim 1, wherein in the changing, the size of the beam is decreased when the magnification is set to magnify the second image.

3. The directivity control apparatus according to claim 1, wherein in the changing, the size of the beam is increased when the magnification is set to demagnify the second image.

4. The directivity control apparatus according to claim 1, wherein in the changing, it is determined whether to adjust a volume level of the sound according to the set magnification.

5. The directivity control apparatus according to claim 4, wherein in the changing, the volume level of the sound is increased when the magnification is set to magnify the second image.

6. The directivity control apparatus according to claim 4, wherein in the changing, the volume level of the sound is decreased when the magnification is set to demagnify the second image.

7. The directivity control apparatus according to claim 1, wherein the processor, when executing the instructions stored in the memory, further performs operations comprising:

processing the second image displayed on the display, wherein in the changing, the size of the beam is maintained when a person is not detected in the second image by image processing.

8. The directivity control apparatus according to claim 7, wherein in the changing, a masking processing is performed on a part of the person in the second image when the magnification is set to magnify the second image.

9. The directivity control apparatus according to claim 1, wherein in the changing, a voice change processing is performed on the sound when the magnification is set to magnify the second image.

10. The directivity control apparatus according to claim 1, wherein the first image is an omnidirectional image.

11. The directivity control apparatus according to claim 1, wherein the directivity of the sound collected by the first sound collector is formed along with the change of the display image from the first image to the second image.

12. The directivity control apparatus according to claim 1, wherein the first image includes distortion, and the second image is generated by correcting the distortion in the partial area of the first image, such that an amount of change in a size of the partial area increases as a position, in the partial area, approaches the center of the first image.

13. A directivity control method of controlling a directivity of a sound collected by a sound collector, including a plurality of microphones, the directivity control method comprising:

displaying a first image on a display;

receiving a first user input designating a position within the first image;

generating, based on the first image, a second image having a center different from a center of the first image and corresponding to a partial area of the first image including the designated position, when the designated position by the first user input does not correspond to the center of the first image, and displaying the second image on the display;

forming a directivity of the sound collected by the sound collector, wherein a direction of the formed directivity is determined based on the center of the second image;

setting a magnification for magnifying or demagnifying the second image on the display according to a second user input to the second image on the display; and changing a size of a beam corresponding to the formed directivity in accordance with the set magnification.

14. The directivity control method according to claim 13, wherein in the changing, the size of the beam is decreased when the magnification is set to magnify the second image.

15. The directivity control method according to claim 13, wherein in the changing, the size of the beam is increased when the magnification is set to demagnify the second image.

16. The directivity control method according to claim 13, wherein in the changing, it is determined whether to adjust a volume level of the sound according to the set magnification.

17. The directivity control method according to claim 16, wherein in the changing, the volume level of the sound is increased when the magnification is set to magnify the second image.

18. The directivity control method according to claim 16, wherein in the changing, the volume level of the sound is decreased when the magnification is set to demagnify the second image.

19. The directivity control method according to claim 13, further comprising processing the second image displayed on the display to detect a person, wherein in the changing, the size of the beam is maintained when a person is not detected in the second image by image processing.

20. The directivity control method according to claim 19, wherein in the changing, a masking processing is performed on a part of the person in the second image when the magnification is set to magnify the second image.

21. The directivity control method according to claim 13, wherein in the changing, a voice change processing is performed on the sound when the magnification is set to magnify the second image.

22. A non-transitory computer readable storage medium, in which a program is stored, the program causing a computer that controls a directivity of a sound collected by a sound collector, including a plurality of microphones, to execute operations of:

displaying a first image on a display;

receiving a first user input designating a position within the first image;

generating a second image having a center different from a center of the first image and corresponding to a partial area of the first image including the designated position, when the designated position by the first user input does not correspond to the center of the first image, and displaying the second image on the display;

forming a directivity of the sound collected by the sound collector, wherein a direction of the formed directivity is determined based on the center of the second image, setting a magnification for magnifying or demagnifying the second image on the display according to a second user input to the second image on the display; and changing a size of a beam corresponding to the formed directivity in accordance with the set magnification.

23. A directivity control system, comprising:

an imager configured to capture a first image in a sound collection area;

a first sound collector, including a plurality of microphones, configured to collect sound in the sound collection area; and a directivity control apparatus, configured to control a directivity of the sound collected by the first sound collector, wherein the directivity control apparatus comprises:

a display;

a memory that stores instructions; and a processor that, when executing the instructions stored in the memory, performs operations comprising:

displaying the first image in the sound collection area captured by the imager on the display;

receiving a first user input designating a position within the first image;

generating, based on the first image, a second image having a center different from a center of the first image and corresponding to a partial area of the first image including the designated position, when the designated position by the first user input does not correspond to the center of the first image, and displaying the second image on the display;

forming a directivity of the sound collected by the first sound collector, wherein a direction of the formed directivity is determined based on the center of the second image;

setting a magnification for magnifying or demagnifying the second image on the display according to a second user input to the second image on the display; and changing a size of a beam corresponding to the formed directivity in accordance with the set magnification.

24. The directivity control system according to claim 23, further comprising a second sound collector which includes a housing having an opening surrounding a periphery of the first sound collector, and arranged concentrically with the first sound collector.

25. The directivity control system according to claim 24, wherein the first sound collector and the second sound collector are spaced from each other in a height direction of the first sound collector and the second sound collector.

26. The directivity control system according to claim 23, further comprising a second sound collector which includes an elliptic housing having an opening surrounding a periphery of the first sound collector.

27. The directivity control system according to claim 23, further comprising a second sound collector which includes a rectangular housing having an opening surrounding a periphery of the first sound collector.

28. The directivity control system according to claim 23, further comprising a second sound collector which includes a honeycomb-shaped housing having an opening surrounding a periphery of the first sound collector.

29. The directivity control system according to claim 23, further comprising a second sound collector including at least one bar-shaped housing in a periphery of the first sound collector.

30. The directivity control system according to claim 23, further comprising at least one second sound collector disposed in a periphery of the first sound collector, wherein the at least one second sound collector is connected to a connector provided in a periphery of the first sound collector via a predetermined signal line accommodating tube.

31. The directivity control system according to claim 23, wherein the first sound collector includes a rectangular housing, the directivity control system further comprising a second sound collector including a rectangular housing which has a same shape as a shape of the first sound collector, wherein each of the housings of the first sound collector and the second sound collector has an intermediate side portion, provided with a semicircular concave surface, and corner portions each provided with a quadrant concave surface.

32. A directivity control system, comprising:

an imager configured to capture a first image in a sound collection area;

a first sound collector, including a plurality of microphones, configured to collect sound in the sound collection area;

a second sound collector, including at least one microphone and disposed in a periphery of the first sound collector; and a directivity control apparatus, configured to control a directivity of the sound collected by the first sound collector and the second collector, wherein the directivity control apparatus comprises:

a display;

a memory that stores instructions; and a processor that, when executing the instructions stored in the memory, performs operations comprising:

displaying the first image in the sound collection area captured by the imager on the display;

receiving a first user input designating a position within the first image;

generating, based on the first image, a second image having a center different from a center of the first image and corresponding to a partial area of the first image including the designated position, when the designated position by the first user input does not correspond to the center of the first image, and displaying the second image on the display;

forming a directivity of the sound collected by the first sound collector, wherein a direction of the formed directivity is determined based on the center of the second image;

setting a magnification for magnifying or demagnifying the second image on the display according to a second user input to the second image on the display; and changing a size of a beam corresponding to the formed directivity in accordance with the set magnification.

* * * * *